US005663039A

United States Patent [19]

Ueda et al.

[11] Patent Number: 5,663,039

[45] Date of Patent: Sep. 2, 1997

[54] SOLID PROCESSING AGENT FOR SILVER HALIDE PHOTOGRAPHIC LIGHT-SENSITIVE MATERIALS

[75] Inventors: Yutaka Ueda; Hiroshi Yamashita; Koji Takemura, all of Hino, Japan

[73] Assignee: Konica Corporation, Tokyo, Japan

[21] Appl. No.: 707,359

[22] Filed: Sep. 4, 1996

Related U.S. Application Data

[60] Continuation of Ser. No. 538,224, Oct. 3, 1995, abandoned, which is a division of Ser. No. 379,898, Jan. 30, 1995, abandoned.

[30] Foreign Application Priority Data

Feb. 3, 1994 [JP] Japan ..... 6-011828
Apr. 8, 1994 [JP] Japan ..... 6-070860

[51] Int. Cl.[6] ..... G03C 5/38

[52] U.S. Cl. ..... 430/465; 430/458

[58] Field of Search ..... 430/458, 460, 430/461, 465

[56] References Cited

U.S. PATENT DOCUMENTS

| | | | |
|---|---|---|---|
| 2,196,901 | 4/1940 | Ham | 430/456 |
| 2,444,803 | 7/1948 | Bean | 430/465 |
| 5,240,822 | 8/1993 | Tanaka et al. | 430/465 |
| 5,351,103 | 9/1994 | Komatsu et al. | 430/398 |
| 5,362,610 | 11/1994 | Yoshimoto | 430/465 |
| 5,366,853 | 11/1994 | Yoshimoto | 430/458 |
| 5,376,509 | 12/1994 | Yoshimoto et al. | 430/465 |
| 5,405,732 | 4/1995 | Shimizu et al. | 430/458 |
| 5,587,277 | 12/1996 | Yamashita et al. | 430/465 |

FOREIGN PATENT DOCUMENTS

| | | |
|---|---|---|
| 0 469 877 A1 | 2/1992 | European Pat. Off. . |
| 0 542 283 A1 | 5/1993 | European Pat. Off. . |
| 0 547 796 A1 | 6/1993 | European Pat. Off. . |

OTHER PUBLICATIONS

Derwent Publications Ltd., "Processing agent for photography–comprising multilayer particles containing additives in outer layer to improve solubility", (1993) Class P83, AN 94–028555 of JP–A–5 093 991 (Abstract).

Derwent Publications Ltd., "Package for photographic processing solution—contains alkaline and developing agents in one package including pressed pellets of dual structure", (1994), Class P83, AN 94–211908 of JP–A–6 148 824 (Abstract).

*Primary Examiner*—Hoa Van Le

*Attorney, Agent, or Firm*—Frishauf, Holtz, Goodman, Langer & Chick, P.C.

[57] ABSTRACT

A solid processing agent for a silver halide photographic light-sensitive material is disclosed in which at least a portion of the surface of the agent is covered with an additive selected from the group consisting of a sulfite and a compound represented by the following Formula (1), (3) or (4):

Formula (1)

Formula (3)

A-COOM.

Formula (4)

8 Claims, 1 Drawing Sheet

SOLID PROCESSING AGENT FOR SILVER HALIDE PHOTOGRAPHIC LIGHT-SENSITIVE MATERIALS

This application is a Continuation of application Ser. No. 08/538,224, filed Oct. 3, 1995, now abandoned, which is a division of Ser. No. 08/379,898, filed Jan. 30, 1995, now abandoned.

FIELD OF THE INVENTION

The invention relates to a solid processing agent for a silver halide photographic light-sensitive material.

BACKGROUND OF THE INVENTION

A silver halide photographic light-sensitive material (hereinafter sometimes referred to a light-sensitive material) is photographically processed through a development step, a bleaching step, a washing step and a stabilization step after being exposed. The photographic processing is ordinarily conducted automatically passing a light-sensitive material through a processing tank containing a processing solution corresponding to the above step and a dryer in an automatic processing machine. On such occasions, a method of replenishing a replenisher prepared in advance is commonly used wherein the processing solution in the processing tank is controlled so that the activity thereof is kept constant. The processing agent for a silver halide photographic light-sensitive material (hereinafter sometimes referred to the processing agent) is marketed in the form of powder or concentrated solution and is dissolved in a specific amount of water to use it. However, such a dissolving operation is often required many times a day and has a danger that the solution is splashed around to pollute the operation space and adheres to an operator's skin.

In order to solve such a problem, a method of directly supplying a solidified processing tablet in the processing tank is disclosed in Japanese Patent O.P.I. Publication No. 5-119454/1993.

Japanese Patent O.P.I. Publication Nos. 4-172341/1992, 5-142714/1993 and 5-204098/1993 disclose a method of covering a surface of processing tablets with a water-soluble polymer.

However, the binding ability of materials used in the processing agent is poor, and the use of the conventional technique disclosed so far cannot give processing agents having a strong binding ability between the materials therein. When the agent is handled, it is broken and causes a loose powder, resulting in various inconveniences in environmental problems and handling and qualitative properties. The processing agent is not always stored in a place where temperature or humidity is well controlled, but is sometimes exposed to a high temperature or humidity. It has been found that when the processing agent is stored in such a circumstance, its deteriorating in quality due to high temperature or its expansion due to heat or moisture adsorption occurs and the normal function thereof cannot be effected. The inventors have tried to prevent the deteriorating or expansion during storage in such a circumstance by adding a preservative or increasing the adding amount, but the object cannot be sufficiently attained.

SUMMARY OF THE INVENTION

An object of the invention is to provide a solid processing agent for a silver halide photographic light-sensitive material capable of giving stable photographic properties less in loose powder occurrence, less in lowering of solubility and excellent in storage stability.

Figure 1:
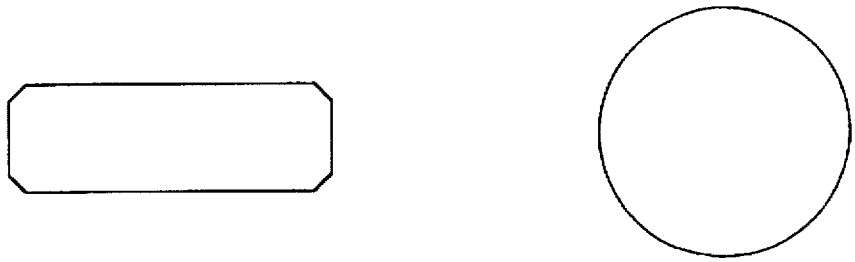
FIG. 1(A) shows one example of a tablet.
FIGS. 1(B) and 1(C) shows a tablet having a layer comprising a covering material thereon.
Figure 1:
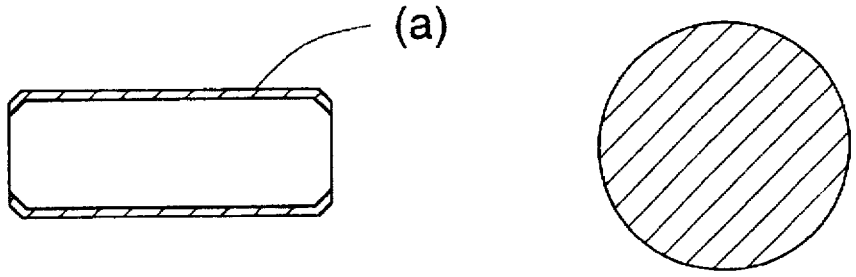
Figure 1:
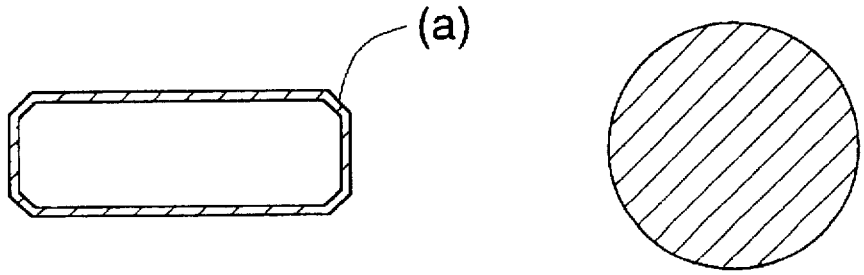

Layer (a) in FIGS. 1(B) and 1(C) shows a layer comprising a covering material.

DETAILED DESCRIPTION OF THE INVENTION

The inventors have made a detailed study on a solid processing agent for a silver halide photographic light-sensitive material and found the following:

The processing agent for a silver halide photographic light-sensitive material contains materials likely subjected to an air oxidation or materials having a high moisture absorption property, and these materials are easily affected by oxygen or moisture penetrating the surface thereof. The inventors have made various studies and found that covering at least a portion of a solid processing agent with at least one compound (hereinafter sometimes referred to additive) selected from compounds represented by Formulae (1)–(4) and a sulfite prevents penetrating the surface thereof of oxygen or moisture, air oxidation of components in the solid processing agent or expansion thereof, and the compound selected from compounds represented by Formulae (1)–(4) and a sulfite is strongly bound on the surface of the agent, resulting in greatly improved anti-abrasion property.

The tablet solid processing agent thickly covered with a water-soluble polymer to prevent an abrasion as disclosed in Japanese Patent O.P.I. Publication Nos. 4-172341/1992, 5-142714/1993 and 5-204098/1993 is relatively slow in speed of dissolving in water or processing solutions as compared with a tablet uncovered with a water-soluble polymer, and often causes temporary lowering of processing ability when a large amount of silver halide photographic light-sensitive materials are processed. Further, such a agent cannot sufficiently prevent the deterioration due to oxidation or expansion due to heat or moisture absorption during storage under a high temperature and humidity.

The inventors have found that the covering at least a portion of a solid processing agent with at least one compound selected from compounds represented by Formulae (1)–(4), a sulfite and a covering agent selected from a water-soluble polymer and a saccharide solves a problem of the slow dissolving speed in the agent covered only with a water-soluble polymer, and the compound selected from compounds represented by Formulae (1)–(4), a sulfite and a covering agent selected from a water-soluble polymer are strongly bound each other on the surface of the processing agent, whereby the processing agent has greatly improved anti-abrasion property and prevents the deteriorating due to oxidation and expansion due to heat or moisture absorption during storage under a high temperature and humidity.

The invention has been attained based on the aforementioned and the object of the invention has been attained by the following:

(Item 1) A solid processing agent for a silver halide photographic light-sensitive material, wherein at least a portion of the surface of the agent is covered with a compound represented by the following Formula (1)

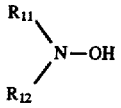

Formula (1)

wherein $R_{11}$ and $R_{12}$ independently represent a hydrogen atom or a substituted or unsubstituted alkyl group, provided that $R_{11}$ and $R_{12}$ may be the same or different or $R_{11}$ and $R_{12}$ may combine each other to form a ring.

(Item 2) A solid processing agent for a silver halide photographic light-sensitive material, wherein at least a portion of the surface of the agent is covered with a covering agent selected from a water-soluble polymer and a saccharide and a compound represented by Formula (1) above.

(Item 3) The solid processing agent for a silver halide photographic light-sensitive material of Item 2, wherein the weight content of the compound represented by Formula (1) is 0.1 to 1 per l of the total weight of the covering agent and said compound.

(Item 4) The solid processing agent for a silver halide photographic light-sensitive material of Item 1, 2, or 3, wherein the compound represented by Formula (1) is a compound represented by the following Formula (2).

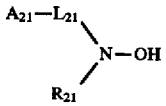

Formula (2)

wherein $R_{21}$ represents a hydrogen atom or a substituted or unsubstituted alkyl group, $L_{21}$ represents a substituted or unsubstituted alkylene group, and $A_{21}$ represents a substituted or unsubstituted carboxyl, sulfo, phosphono, phosphinic acid, hydroxy, amino, ammonio, carbamoyl or sulfamoyl group. $R_{21}$ and $L_{21}$ may combine each other to form a ring.

(Item 5) A solid processing agent for a silver halide photographic light-sensitive material, wherein at least a portion of the surface of the agent is covered with a compound represented by the following Formula (3)

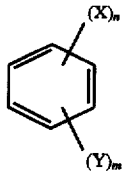

Formula (3)

wherein X represents an alkyl group or —OH, n represents an integer of 0 to 3, provided that when n is 2 or more, X may be the same or different, Y represents —COOM or $—SO_3M$ in which M represents a hydrogen atom, an alkali metal or $—NH_4$, and m represents an integer of 1 to 3, provided that when m is 2 or more, Y may be the same or different.

(Item 6) A solid processing agent for a silver halide photographic light-sensitive material, wherein at least a portion of the surface of the agent is covered with a covering agent selected from a water-soluble polymer and a saccharide and a compound represented by Formula (3) above.

(Item 7) The solid processing agent for a silver halide photographic light-sensitive material of Item 6, wherein the weight content of the compound represented by Formula (3) is 0.1 to 1 per l of the total weight of the covering agent and said compound.

(Item 8) A solid processing agent for a silver halide photographic light-sensitive material, wherein at least a portion of the surface of the agent is covered with a compound represented by the following Formula (4)

A—COOM

Formula (4)

wherein A represents a substituted alkyl or alkenyl group, in which the substituent is —OH or —COOM, and M represents a hydrogen atom, an alkali metal or $—NH_4$.

(Item 9) A solid processing agent for a silver halide photographic light-sensitive material, wherein at least a portion of the surface of the agent is covered with a covering agent selected from a water-soluble polymer and a saccharide and a compound represented by Formula (4) above.

(Item 10) The solid processing agent for a silver halide photographic light-sensitive material of Item 9, wherein the weight content of the compound represented by Formula (4) is 0.1 to 1 per l of the total weight of the covering agent and said compound.

(Item 11) A solid processing agent for a silver halide photographic light-sensitive material, wherein at least a portion of the surface of the agent is covered with a sulfite.

(Item 12) A solid processing agent for a silver halide photographic light-sensitive material, wherein at least a portion of the surface of the agent is covered with a covering agent selected from a water-soluble polymer and a saccharide and a sulfite.

(Item 13) The solid processing agent for a silver halide photographic light-sensitive material of Item 1, wherein the weight content of the sulfite is 0.1 to 1 per l of the total weight of the covering agent and the sulfite.

(Item 14) A solid processing agent for a silver halide photographic light-sensitive material of Item 1, 2, 3, 4, 5, 6, 7, 8, 9, 10, 11, 12 or 13, wherein the agent is in the form of tablets.

(Item 15) The solid processing agent for a silver halide photographic light-sensitive material of Item 14, wherein the agent is in the form of specific geometrical tablets.

The invention will be detailed below.

The solid processing agent refers to a solid processing agent in the form of powder, granules or tablets. The powder herein referred to is an aggregation of fine crystals. The granules herein referred to are obtained by granulating the powder, and these granules have a particle size within the range of 50 to 5000 μm. The tablet refers to one obtained by compression-molding powder or granules into a definite form. When the agent is in the form of granules or tablets, the effects of the invention are display markedly. The agent is preferably in the form of specific geometrical tablets in view of handling or reliability of supplying. When the agent of the invention applies to the specific geometrical tablets, There is a merit that the geometrical form is maintained. The invention are markedly effected in tablets having a weight per tablet of 0.1 g or more (especially 1 g or more).

Tablets are prepared by a method disclosed in Japanese Patent O.P.I. Publication Nos. 51-61837 and 54-155038, granules are prepared by a method disclosed in Japanese Patent O.P.I. Publication Nos. 2-109042 and 2-109043, and powder is prepared by a method disclosed in Japanese Patent O.P.I. Publication No. 54-13332 and Geman Patent No. 3,733,861.

A granular solid processing agent will be detailed below.

As for the granulating processes for forming granules, it is possible to use any of the well-known processes such as the processes of a rolling granulation, an extrusion granulation, a compression granulation, a cracking granulation, a stirring granulation, a fluidized-layer granulation and a spray-dry granulation. For forming tablets, it is preferable to use the granules having an average particle size of preferably 100 to 1000 μm, more preferably 200 to 800 μm in that segregation occurs with difficulty on mixing or compression. The average particle size in the invention refers to an arithmetical average of a particle diameter obtained by a sieve analysis. The particles are screened with plural JIS standard, sieves and the average particle diameter is represented by the following equation:

$$D=(\Sigma nd)/(\Sigma n)$$

wherein D is an average particle diameter, n is frequency and d is a center value. As to particle diameter distribution 60% or more of the granules is preferably within a deviation of ±100–150 μm.

When the granules are compressed, the well known compressors such as a hydraulic press machine, a single tableting machine, a rotary tableting machine and a bricketing machine can be used. The weight of tablets obtained by compression-molding is preferably 0.5 to 50 g per tablet in view of producibility, automatical supplying or handling, whereby the invention is markedly effected.

The tablet solid processing agent will be explained below.

The preferable manufacturing method is a method of mixing and kneading photographic agents in the form of powder or concentrated solution with a water-soluble binder, granulating the mixture and molding it into tablets. This method has advantages that solubility and storage stability are improved and photographic properties are stabilized as compared a method of mixing photographic agents and molding the mixture into tablets. The tablets are preferably in the cylindrical or convex lens form and has a diameter of preferably 10 to 50 mm. A part of components in the processing agents may be tableted, but it is preferable that all the components in the processing agents are tableted. For example, in the color developing composition an alkali agent, a color developing agent and a reducing agent may be individually tableted, but it is preferable that all the agents are contained in the same tablet solid processing agent.

The coverage of the invention will be explained below.

In the coverage of the invention at least a portion of the surface of the solid processing agent is covered. Whether or not at least a portion of the surface of the agent is covered with an additive or a covering agent is judged from whether or not the concentration of the additive or covering agent on the surface of the agent is high as compared with an average concentration of the additive or covering agent in the inner portion of the agent. In the invention not less than ½ (especially not less than 70%) of the surface area of the agent preferably has a covering agent or additive concentration higher than the average concentration of the additive or covering agent in the inner portion of the agent. The entire surface of the solid processing agent is preferably covered with an additive or a covering agent.

In the invention a method of covering the surface of a granular solid processing agent includes a method of splashing the agent with a solution of at least one compound selected from compounds represented by Formula (1)–(4) and a sulfite and drying it in the conventional fluid-bed type dryer, but the invention is not limited thereto.

The covering method of the surface of the tablet solid processing agent will be given below, but the invention is not limited thereto.

(1) A covering agent is melt by heating or dissolved in a solvent. Then a solid processing tablet is dipped into the solution and took out therefrom, followed by drying.

(2) The covering agent is dissolved in a solvent or melt by heating. And while flowing the solution, the solution is coated on the surface of the solid processing tablet, followed by drying and drying it.

(3) The covering agent is dissolved in a solvent or melt by heating. Then the solution is sprayed on the surface of the solid processing tablet, which is then dried.

The spray coating of above (3) among these methods is especially preferable one from the point of the object of the present invention.

The spray coating is explained further in detail. First, a coating solution is prepared by dissolving or suspending the coating agent in water, an organic solvent or the mixture thereof. Water or an organic solvent such as methanol or ethanol can be used as a solvent, however, water is preferable from the point of preventing an accident such as ignitions.

Moreover, when the covering agent is a compound having a relatively low melting point, melting by heat may also be applied.

As for a coating method, pan coating is preferable, wherein while rotating a pan containing therein solid processing tablets, a coating solution is poured or sprayed on the surface of the solid processing tablets, followed by sending hot air inside the pan to remove solvent and dry the coated material.

Upon removal of the solvent or drying the coated, pressure inside the pan may be decreased. Also, two or more, kinds of coating solutions may be used successively, so that a plurality of layers are provided on the surface of the tablets.

As another method, the solid processing tablets are made line up on a belt and then the coating solution is sprayed thereon, followed by drying. In this case, if a net-like belt is used, the coating solution may be from both upper and lower sides of the tablets and simultaneous coating can be performed. If the system is so designed that tablets move on the belt from the spraying process to the drying process, a continuous manufacture of the solid processing tablets is also possible.

Now, the compounds used in the invention represented by Formula (1) will be detailed.

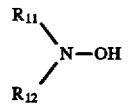

Formula (1)

wherein $R_{11}$ and $R_{12}$ independently represent a hydrogen atom or a substituted or unsubstituted alkyl group, provided that $R_{11}$ and $R_{12}$ may be the same or different or $R_{11}$ and $R_{12}$ may combine each other to form a ring. The alkyl group of $R_{11}$ and $R_{12}$ are preferably one having not more than 3 carbon atoms. The substituent is preferably —OH, —COOM or —$SO_3M$ wherein M represents a hydrogen atom, an alkali atom or —$NH_4$, and more preferably —OH, —COOH, —COONa, —$SO_3H$ or —$SO_3Na$.

Of compounds represented by Formula (1) a compound represented by Formula (2) is preferable.

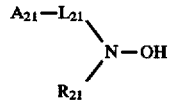

Formula (2)

wherein $R_{21}$ represents a hydrogen atom or a substituted or unsubstituted, straight-chained or branched alkyl group. $L_{21}$ represents a substituted or unsubstituted, straight-chained or branched alkylene group. $A_{21}$ represents substituted or unsubstituted carboxyl, sulfo, phosphono, phosphinic acid, hydroxy, amino, ammonio, carbamoyl or sulfamoyl group. $R_{21}$ and $L_{21}$ may combine each other to form a ring. The alkyl group of $R_{21}$ has carbon atoms of preferably 1 to 10, more preferably 1 to 5. The substituents of $R_{21}$ include a carboxy group, a sulfo group, a phosphono group, a phosphinic acid residual group, a hydroxy group or an alkyl-substitutable ammonio, amino, carbamoyl or sulfamoyl group. $R_{21}$ may have two substituents. $R_{21}$ preferably includes a hydrogen atom, a carboxymethyl group, a carboxyethyl group, a carboxypropyl group, a sulfoethyl group, a sulfopropyl group, a phosphonomethyl group, a phosphonopropyl group and a hydroxyethyl group. The alkylene group of $L_{21}$ has carbon atoms of preferably 1 to 10, more preferably 1 to 5. To be more concrete, the preferable examples thereof include a methylene group, an ethylene group, a trimethylene group and a propylene group. The substituents thereof preferably include a carboxy group, a sulfo group, a phosphono group, a phosphinic acid residual group, a hydroxy group, an alkyl-substitutable ammonio group and, among them, the more preferable examples thereof include a carboxy group, a sulfo group, a phosphono group and a hydroxy group. $A_{21}$ represents a carboxy group, a sulfo group, a phosphono group, a hydroxy group or an alkyl-substitutable ammonio group. The examples of $—L_{21}—A_{21}$ include, preferably, a carboxymethyl group, a carboxyethyl group, a carboxypropyl group, a sulfoethyl group, a sulfopropyl group, a sulfobutyl group, a phosphonomethyl group, a phosphonoethyl group and a hydroxyethyl group and, among them, the particularly preferable examples thereof include a carboxymethyl group, a carboxyethyl group, a sulfoethyl group, a sulfopropyl group, a phosphonomethyl group and a phosphonoethyl group.

Of compounds represented by Formula (1) a compound represented by Formula (6) is especially preferable.

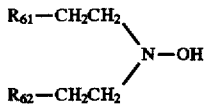

Formula (6)

wherein $R_{61}$ and $R_{62}$ independently represent —OH, —COOM or $—SO_3M$ in which M represents a hydrogen atom or an alkali metal.

Next, among the compounds represented by Formula (I), typical examples will be given below.

1-1

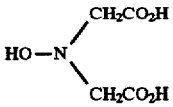

1-2

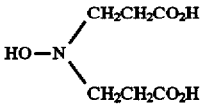

1-3

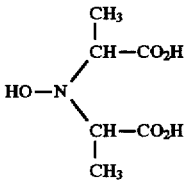

1-4

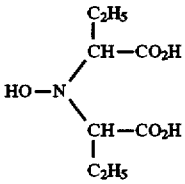

1-5

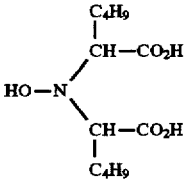

1-6

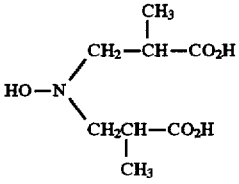

-continued 1-7

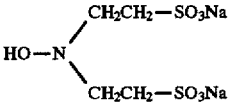

1-8

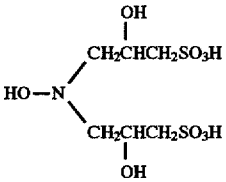

1-9

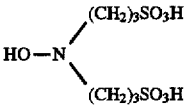

1-10

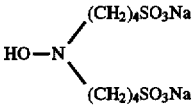

1-11

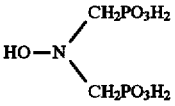

1-12

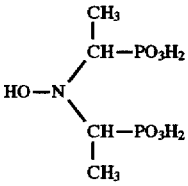

1-13

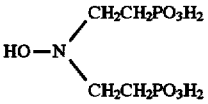

1-14

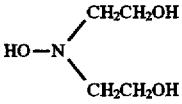

1-15

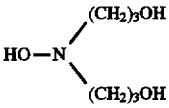

1-16

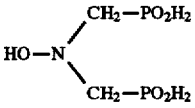

1-17

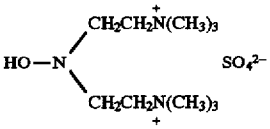

1-18

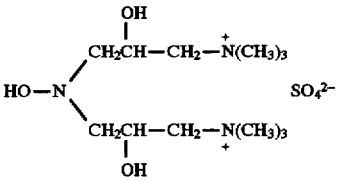

1-19

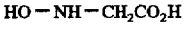

1-20

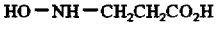

1-21

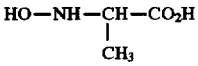

1-22

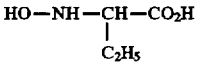

-continued
1-23
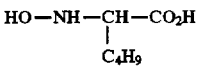
1-24
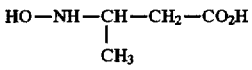
1-25
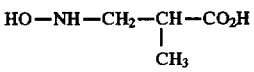
1-26
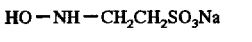
1-27
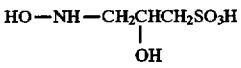
1-28
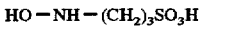
1-29
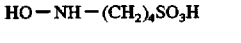
1-30
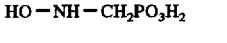
1-31
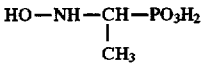
1-32
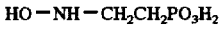
1-33
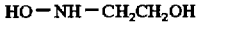
1-34
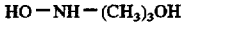
1-35
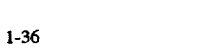
1-36
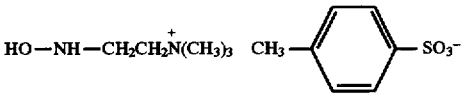
1-37
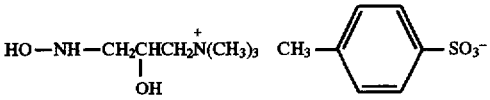
1-38
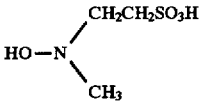
1-39
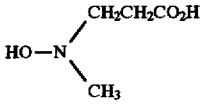
1-40
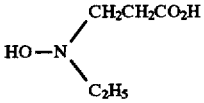
1-41
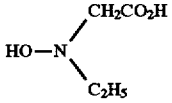
1-42
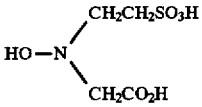
1-43
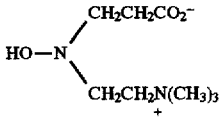
-continued
1-44
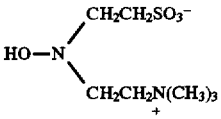
1-45
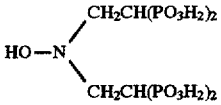
1-46
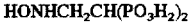
1-47
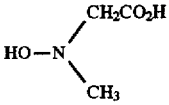
1-48
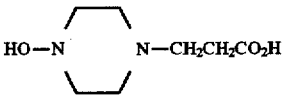
1-49
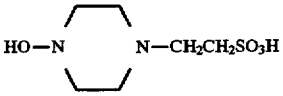
1-50
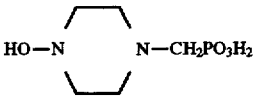
1-51
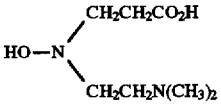
1-52
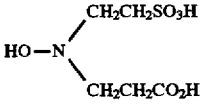
1-53
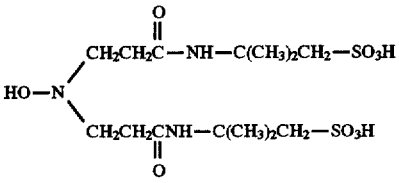
1-54
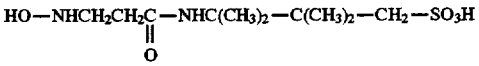
1-55
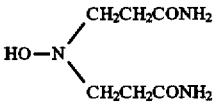
1-56
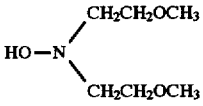
1-57
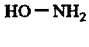
1-58
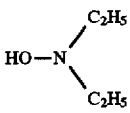

The typical examples include salts of these exemplified compounds with oxalic acid, surfuric acid, hydrochloric acid, PTS, phosphoric acid, acetic acid, sodium or potassium. Of these exemplified compounds, the preferable are 1-2, 1-3, 1-7, 1-10, 1-11, 1-13, 1-14, 1-19, 1-24, 1-26, 1-30, 1-33, 1-36, 1-38, 1-42, 1-47, 1-50, 1-55 and 1-56 and the especially preferable are 1-2, 1-7, 1-13, 1-14 and 1-56.

Now, the compounds used in the invention represented by Formula (3) will be detailed.

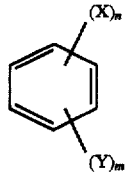

Formula (3)

wherein X represents a hydrogen atom, an alkyl group or —OH, n represents an integer of 0 to 3, provided that when n is 2 or more, X may be the same or different, Y represents —COOM or —$SO_3M$, and m represents an integer of 1 to 3, provided that when m is 2 or more, Y may be the same or different. The alkyl group of X preferably has not more than 3 carbon atoms. M in the —COOM or —$SO_3M$ of Y may have a positive charge, preferably a hydrogen atom, an alkali metal or —$NH_4$, and more preferably a hydrogen atom, Na or K. n is preferably 2 or less. The example of a compound represented by Formula (3) will be shown below in the form of the following Formula (5):

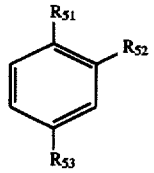

Formula (5)

| Compound No. | $R_{51}$ | $R_{52}$ | $R_{53}$ |
|---|---|---|---|
| [3-1] | $-CH_3$ | —H | $-SO_3H$ |
| [3-2] | $-CH_3$ | —H | $-SO_3Na$ |
| [3-3] | $-CH_3$ | —H | $-SO_3K$ |
| [3-4] | —H | $-CH_3$ | $-SO_3K$ |
| [3-5] | —H | —H | $-SO_3H$ |
| [3-6] | —OH | —H | $-SO_3H$ |
| [3-7] | —H | —H | —COOH |
| [3-8] | —H | —H | —COONa |
| [3-9] | —H | —H | —COOK |
| [3-10] | —H | —OH | —COONa |
| [3-11] | —OH | —COONa | —H |
| [3-12] | —OH | —COOH | $-SO_3H$ |
| [3-13] | —OH | —COOH | $-SO_3Na$ |

Of these exemplified compounds, the preferable are 3-1, 3-2, 3-3, 3-4, 3-7, 3-8, 3-9, 3-10 and 3-13, and the especially preferable are 3-1, 3-2, 3-4, 3-8 and 3-9.

Now, the compounds used in the invention represented by Formula (4) will be detailed.

A—COOM Formula (4)

wherein A represents a substituted alkyl or alkenyl group and the substituent is —OH or —COOM wherein M represents a hydrogen atom, an alkali metal or —$NH_4$. The substituted alkyl group of A preferably has a —OH substituent. The substituted alkyl or alkenyl group of A preferably has not more than 5 carbon atoms. Of compounds represented by Formula (4) a compound represented by Formula (7) or (8) is preferable.

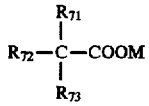

Formula (7)

wherein $R_{71}$, $R_{72}$ and $R_{73}$ independently represent a hydrogen atom or a substituted alkyl group and may be the same or different. The alkyl group preferably has 4 or less carbon atoms. The substituent is —OH or —COOM wherein M preferably represents Na, K, $NH_4$ or H.

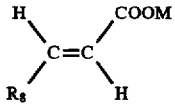

Formula (8)

wherein $R_8$ represents a hydrogen atom or a substituted alkyl group and may be the same or different. The alkyl group preferably has 4 or less carbon atoms. The substituent is —OH or —COOM wherein M preferably represents Na, K, $NH_4$ or H.

Next, typical examples of the compounds represented by Formula (4) will be given below by showing the typical group in Formula (7) or (8).

Formula (7)

| Compound No. | M | $R_{71}$ | $R_{72}$ | $R_{73}$ |
|---|---|---|---|---|
| [4-1] | H | —COOH | —OH | —COOH |
| [4-2] | H | —COOH | —OH | —COONa |
| [4-3] | K | —COOH | —OH | —COOK |
| [4-4] | H | —H | —OH | —H |
| [4-5] | Na | —H | —OH | —H |
| [4-6] | H | $-(CH_2)_2COOH$ | —H | —H |
| [4-7] | Na | $-(CH_2)_2COONa$ | —H | —H |
| [4-8] | H | $-CH_2COOH$ | —OH | —H |
| [4-9] | Na | $-CH_2COONa$ | —OH | —H |
| [4-10] | H | —CH(OH)COOH | —OH | —H |
| [4-11] | Na | —CH(OH)COONa | —OH | —H |
| [4-12] | H | $-CH_3$ | —OH | —H |
| [4-13] | Na | $-CH_3$ | —OH | —H |

Formula (8)

| Compound No. | M | $R_8$ |
|---|---|---|
| [4-14] | H | —COOH |
| [4-15] | Na | —COONa |

Next, the sulfite in the invention will be explained. The sulfite in the invention may be any sulfite, and is preferably sodium sulfite, potassium sulfite or ammonium sulfite.

The weight content of the compound represented by Formula (1), (3) or (4) or a sulfite is preferably 0.1 (especially 0.2) to 1 (especially 0.7) based on 1 of the total amount of a covering material used for coverage. The total amount of the covering material used for coverage is pregerably 0.05% or more by weight (especially 0.2% or more by weight), and preferably 5% or less by weight (especially 2% or less by weight) based on the total weight of the solid processing agent.

The covering agent in the invention refers to a water-soluble polymer or saccharide. As described previously, the solid processing agent in the invention is preferably covered with at least one covering agent selected from a water-soluble polymer and a saccharide. Of the covering agent the preferable will be given below.

The water-soluble polymer includes polyalkylene glycol, polyvinyl alcohol, polyvinyl pyrrolidone, polyvinyl acetal, polyvinyl acetate, an aminoalkylmethacrylate copolymer, a methacrylic acid-methacrylate copolymer, a methacrylic acid-acrylate copolymer and a methacrylic acid betaine type polymer. The polyalkylene glycol preferably includes a compound represented by the following Formula (9):

$$HO-(AO)_s-(BO)_t-(CO)_u-H \qquad \text{Formula (9)}$$

wherein A, B and C may be the same or different and represent a straight-chained or branched alkylene group having 1 to 5 carbon atoms, and s, t and u independently represent an integer of 0 to 500. Of these polyethylene glycol, polypropylene glycol or polyisopropylene glycol having a weight average molecular weight of 400 to 20,000 is preferably used in the invention. A copolymer in which polyethylene glycol having a weight average molecular weight of 2,000 to 8,000 is copolymerized with polypropylene glycol or polyisopropylene glycol in a specific ratio is preferably used in the invention. To be more concrete, polyethylene glycol having a weight average molecular weight of 1,500 to 10,000 is especially preferable. The polyalkylene glycols are available on the market. For example, polyethylene glycol having a weight average molecular weight of 1,540, 2,000, 4,000, 6,000 or 10,000 is available on the market.

The methacrylic acid polymer having a betaine structure is apparent from those disclosed in Japanese Patent O.P.I. Publication Nos. 2-300110, 3-135911 and 3-141216, and is concretely a copolymer of compound (1), (2) or (3) or a copolymer of compound (1'), (2) or (3) represented by Formula (10). The compound of (1') is obtained from compound of (1) by a method disclosed in Japanese Patent O.P.I. Publication No. 55-17009.

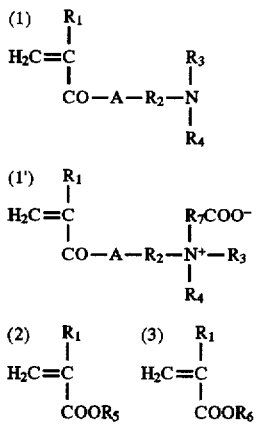

In the Formula, $R_1$ through $R_7$ and A independently represent the following group:

$R_1$=a hydrogen atom or a methyl group $R_2$=an alkylene group having 1 to 4 carbon atoms $R_3$, $R_4$ and $R_7$=an alkyl group having 1 to 3 carbon atoms $R_5$=an alkyl group having 12 to 14 carbon atoms $R_6$=an alkyl group having 1 to 11 carbon atoms or a cycloalkyl group A=O or NH Monomer (1) is a derivetive of acrylic acid or methacrylic acid (hereinafter referred to (meth)acrylic acid) represeneted by Formula (1). In Formula the substituents are as described above, and it is preferable that $R_1$ represents methyl, $R_2$ represents an alkylene group having 2–3 carbon atoms, $R_3$ and $R_4$ represent methyl or ethyl or A represents O.

The example of Monomer (1) includes a dimethylaminoethyl(meth)acrylate, a diethylaminoethyl (meth)acrylate, a dimethylaminopropyl(meth)acrylate, a dimethylaminoethyl(meth)acrylamide, or a diethylaminopropyl(meth)acrylamide.

The used amount of Monomer (1) is 25 to 50 weigh %, and preferably 30 to 45 weight % based on the total monomer content.

Monomer (2) is a (meth)acrylate represeneted by Formula (2). It is preferable that $R_1$ represents methyl or $R_5$ represents an alkyl group.

The example of Monomer (2) includes lauryl(meth) acrylate, tridecyl(meth)acrylate, oleyl(meth)acrylate, stearyl (meth)acrylate or behenyl(meth)acrylate.

The used amount of Monomer (2) is 10 to 40 weigh %, and preferably 15 to 35 weight % based on the total monomer content.

Monomer (3) is a (meth)acrylate represeneted by Formula (3). $R_1$ preferably represents methyl or $R_6$ preferably represents an alkyl group or more preferably a branched alkyl group such as iso or tertiary.

The example of Monomer (3) includes methyl(meth) acrylate, n-propyl(meth)acrylate, iso-propyl(meth)acrylate, n-butyl(meth)acrylate, iso-butyl(meth)acrylate, tert-butyl (meth)acrylate, 2-ethylhexyl(meth)acrylate or cyclohexyl (meth)acrylate.

The used amount of Monomer (3) is 10 to 65 weigh %, and preferably 15 to 60 weight % based on the total monomer content.

In order to obtain optimum flexibility or hardness and change the touch of films, polymerizable monomer (4) (Monomer (4)) other than the above monomers (1) through (3) may be contained in the copolymer.

The example of Monomer (4) includes a (meth)acrylate derivative such as hydroxypropyl(meth)acrylate, polyethylene glycol mono(meth)acrylatemethyl(meth)acrylate, (meth)acryloxypropyltrimethoxysilane, (meth)acrylamide or diacetoneacrylamide, an aromatic complex monomer such as styrene, chlorostyrene or vinyltoluenen-propyl (meth)acrylate, a polymerizable monomer such as N-vinylpyrrolidone or vinylacetate.

The used amount of Monomer (4) is 0 to 20 weight %, and preferably 0 to 15 weight % based on the total monomer content.

The polymerization of (1) through (3) or (1'), (2), (3) represented by Formula (10) can be conducted according to a conventional synthetic method. These copolymers have a weight average molecular weight of preferably 1000 to 200,000. The preferable exemplified compounds will be shown below. These compounds, for example, Yuka Former AM-75 produced by Mitsubishi Yuka Co., Ltd. are available on the market.

TABLE 1

| | Monomer Composition (%) | | | | Weight Average |
|---|---|---|---|---|---|
| | Monomer (1) | Monomer (2) | Monomer (3) | Monomer (4) | Molecular Weight |
| B-1 | Dimethylamino-<br>ethylmethacrylate 35 | Tridecyl-<br>methacrylate 20<br>Stearyl- | tert-<br>Butmethacrylate 25<br>Methyl- | 10 | 75,000 |

TABLE 1-continued

| | Monomer Composition (%) | | | | | | | | | Weight Average |
|---|---|---|---|---|---|---|---|---|---|---|
| | Monomer (1) | | Monomer (2) | | Monomer (3) | | Monomer (4) | | | Molecular Weight |
| | | | methacrylate | | methacrylate | | | | | |
| B-2 | Dimethylamino-ethylmethacrylate | 35 | Tridecyl-methacrylate Stearyl-methacrylate | 20 10 | tert-Butmethacrylate Methyl-methacrylate | 25 10 | | | | 8,500 |
| B-3 | Dimethylamino-ethylmethacrylate | 45 | Laurylmethacrylate Palmityl-methacrylate | 15 10 | iso-Butyl-methacrylate | 30 | | | | 160,000 |
| B-4 | Dimethylamino-ethylmethacrylate | 30 | Tridecyl-methacrylate | 30 | 2-Hexylacrylate Ethyl-methacrylate | 15 15 | N-Vinyl-pyrrol-idone | 10 | | 70,000 |
| B-5 | Dimethylamino-ethylmethacrylate | 20 | Laurylmethacrylate | 35 | Methyl-methacrylate | 45 | | | | 60,000–80,000 |
| B-6 | Dimethylamino-ethylmethacrylate | 60 | Laurylmethacrylate | 15 | Methyl-methacrylate tert-Butyl-metacrylate | 10 15 | | | | 60,000–80,000 |
| B-7 | Dimethylamino-ethylmethacrylate | 45 | Tridecyl-methacrylate | 5 | Methyl-methacrylate iso-Butyl-methacrylate | 30 20 | | | | 60,000–80,000 |
| B-8 | Dimethylamino-ethylmethacrylate | 45 | Laurylmethacrylate Stearyl-methacrylate | 40 10 | Methyl-methacrylate | 5 | | | | 60,000–80,000 |
| B-9 | N-carboxymethyl-dimethylamino-ethylmethacrylate | 35 | Tridecyl-methacrylate Stearyl-methacrylate | 20 10 | tert-Butyl-methacrylate Methyl-methacrylate | 25 10 | | | | 60,000–80,000 |

The saccharide includes a monosaccharide such as glucose or galactose, a disaccharide such as maltose, sucrose or lactose, a sugar alcohol such as mannitol, sorbitol or erythritol, pullulan, methylcellulose, ethylcellulose, hydroxypropylcellulose, hydroxypropylmethylcellulose, cellulose acetate phthalate, hydroxypropylmethylcellulose phthalate, hydroxypropylmethylcellulose acetate succinate, carboxymethylethylcellulose, dextrins or a starch dissociate.

Of these the preferable are erythritol, maltose, dextrins represented by Pineflow or Pinedex produced by Matsutani Kagaku Co., Ltd., starch dissociates or methacrylic betaine polymers represented by Yuka Former produced by Mitsubishi Yuka Co., Ltd. The solid processing agent is covered with at least one covering agent selected from these water-soluble polymers or saccharides, but the covering agent may be contained in the inner portions of the solid processing agent. The water-soluble polymers or saccharides for coverage of the solid processing agent may be the same as or different from those contained in the inner portions thereof.

When the solid processing agent of the invention is covered with at least one covering agent selected from a water-soluble polymer and a saccharide and at least one compound selected from compounds represented by Formulae (1) through (4) and a sulfite, the weight content of these covering materials is preferably 0.05% or more (especially 0.2% or more), or preferably 5% or less (especially 2% or less) based on the weight of the solid processing agent in order to prevent accumulation of the water-soluble polymer in the processing solution, its adversed affect on processing, salting out in a high salt concentrated solution such as bleach or fixer or oily floating matter occurrence.

The solid processing agent of the present invention can be used for developer for black-and-white and color photographic materials such as black-and-white negative films, color negative films, color papers, color reversal films and color reversal papers, bleach, bleach-fixer, fixer, stabilizer, rinse, stopper, a reversing agent and an adjusting agents (conditioner).

The component agent in the solid processing agent will be explained below.

As for a developing agent used for black-and-white photography of the invention, for example, 1,4-dihydroxybenzene compounds, p-Aminophenol compounds and pyrazolidone compounds are preferable. As for the color developing agent used in the color developer of the present invention, p-phenylenediamine compounds having a water solubilizing group are preferably used in view of less fog. The p-phenylenediamine compounds having a water solubilizing group have advantage that stains are not produced on a light-sensitive material and a rash is not produced on the skin, as compared with p-phenylenediamine compounds without a water solubilizing group. The above-described p-phenylenediamine compounds have at least one water solubilizing group on their amino group or benzene ring. The examples of the hydrophilic group include $—(CH_2)_n—CH_2OH$, $—(CH_2)_m—NHSO_2—(CH_2)_n—CH_3$, $—(CH_2)_m—O—(CH_2)_n—CH_3$, $—(CH_2CH_2O)_nC_mH_{2m+1}$ (m and n independently represent an integer of not less than 0), —COOH and $—SO_3H$. The color developing agent is preferably used in the salt form of hydrochloride, sulfate or p-toluenesulfonate. The color developing agent may be used singly or in combination of two or more kinds, and optionally used in combination with a black-and-white developing agent.

When in the invention the solid color developing agent contains a preservative, especially a compound represented by the following Formula (A)

$$R_{a1}—N—(OH)—R_{a2} \qquad \text{Formula (A)}$$

In Formula (A), $R_{a1}$ and $R_{a2}$ may be the same or different, and independently represent an alkyl group, an aryl group, —CO—R' or a hydrogen atom. The alkyl group of $R_{a1}$ and $R_{a2}$ may be the same or differrent, and preferably has 1 to 3 carbon atoms. Further, the alkyl group has a carboxyl group, a phosphoric acid group, a sulfonic acid group or a hydroxy group as a substituent. R' represents an alkoxy group, an alkyl group or an aryl group. The alkyl or aryl group of $R_{a1}$, $R_{a2}$ and R' includes one having a substituent, provided that $R_{a1}$ and $R_{a2}$ may combine each other to form a ring such as piperidine, pyridine, triazine or morpholine.

The hydroxylamine compound represented by Formula (A) is preferably a hydroxylamine salt, or an N-alkyl hydroxylamine or N,N-dialkyl hydroxylamine or a salt thereof. The especially preferable is a bis(2-sulfo) hydroxylamine disodium salt, a bis(2-carboxyethyl) hydroxylamine disodium salt or hydroxylamine sulfate.

The compound represented by Formula (A) is generally used in the form of a free amine, a hydrochloride, a sulfate, a p-toluene sulfonate, an oxalate, a phosphate or an acetate.

As a preservative in the solid color developing agent of the invention a sulfite such as sodium sulfite, potassium sulfite, sodium bisulfite or potassium bisulfite, a saccharide or a hydrazine derivative can be used as well as compounds represented by Formula (A). The solid color or black-and-white developing agent preferably contains an alkali salt of carbonate, bicarbonate, phosphate, borate, tetraborate, o-hydroxybenzoate or 2-hydroxy-5-sulfo-benzoate of the invention as a buffering agent.

As development accelerators thioether type compounds, p-phenylene diamine type compounds, quaternary ammonium salts, p-aminophenols, amine type compounds, polyalkylene oxides, a 1-phenyl-3-pyrazolidone, a hydrazine, a mesoionic type compound, an ionic type compound or an imidazole are preferably added.

For the purposes of preventing a fog production, chlorine ion and bromine ion may also be applied to the color developing solution in the processing tank. In the invention the developing solution preferably contains $1.0\times10^{-2}$ to $1.5\times10^{-1}$ mol/liter of a chloride ion or $3.0\times10^{-3}$ to $1.0\times10^{-2}$ mol/liter of a bromide ion. The solid developing agent preferably contains as a chlorine ion supplying agent sodium chloride or potassium chloride and as a bromine ion supplying agent sodium bromide or potassium bromide.

If required, the solid color developing agent or solid developing agent of the invention are allowed to be further added with any desired antifoggant, in addition to the chloride ion and bromide ion. The antifoggant includes an alkali-metal halide such as potassium iodide and an organic antifoggant.

Further, an auxiliary developing agent may also be used together with a developing agent. The auxiliary developing agent is preferably metol, phenidone, N,N-diethyl-p-aminophenol hydrochloride and N,N,N',N'-tetramethyl-p-phenylene diamine hydrochloride.

Still further, a variety of additives such as an antistaining agent, an antisludging agent and an interlayer-effect accelerator may be used.

The solid bleaching agent or solid bleach-fixing agent preferably contains an amino polycarboxylic acid metal complex such as ethylenediaminetetraacetic acid ferric complex, diethylenetriaminepentaacetic acid ferric complex, or 1,3-propanediaminetetraacetic acid ferric complex as a bleaching agent. The solid fixing agent or solid bleach-fixing agent preferably contains a thiosulfate, a thiocyanate, thiourea, a thioether compound or a meso-ion compound as a fixing agent. The stabilizing agent in the solid stabilizing agent in the invention includes a hexamethylenetetramine compound, a N-methylol compound, an aromatic or heterocyclic aldehyde, acetals or hemiacetals.

As a packaging embodiment of the solid processing agent of the present invention tablets may be individually packaged in an individual package. However, the effect of the present invention will be exerted more remarkably when a plurality of granules or tablets are contained in a package. It is especially preferable that a plurality of tablets are contained lined up regularly in the same direction in a package. A plurality of powder, granules or tablets may be contained in a package.

In continuously processing a silver halide light-sensitive material, it is preferable for the solid processing agent of the invention to be directly added to a processing bath or a circulatory system connected thereto in the processor. It is preferable that the agent is added to an auxiliary tank connected to the processing bath and having a heater. It is preferable that a pump is provided in the auxiliary tank so as to transfer a solution from the processing bath in a specific amount and to maintain constant temperature, and a filter so as to remove insoluble matters produced by contamination or crystallization. The filter prevents insoluble matters of the solid processing agent from incorporating into the processing bath and adhering to the light-sensitive material. When an incorporating means for a processing agent is provided in the processing bath, a device such as an interceptor is provided so that the insoluble matters does not directly contact a photographic film. It is preferable that water is replenished separately to dilute waste matter accumulated in the processing solution.

A means for supplying the solid processing agent in the processing bath or a circulation portion connected thereto includes a method disclosed in Japanese Utility Model O.P.I. Publication Nos. 63-137783 and 63-97522 and 1-85732.

It is preferable in the invention that the solid processing agent is supplied in each processing bath according to the processed amount of a light-sensitive material. Water is optionally replenished according to the processed amount of a light-sensitive material or another replenishing control system.

An automatic developing machine as disclosed in Japanese Utility Model Application No. 5-213008 is used in the invention.

EXAMPLES

The invention will be detailed below, but is not limited thereto.

Example 1

A granular solid processing agent for a color negative film was prepared in the following procedures.

1) A granular solid processing agent for a color negative film

Procedure (1)

In a bandamu mill available on the market, 3750.0 g of anhydrous potassium carbonate, 580.0 g of sodium sulfite, 240.0 g of pentasodium diethylenetriamine pentaacetate, 500.0 g of sodium p-toluene sulfonate and 500.0 g of bis(2-sulfoethyl)hydroxylamine disodium were pulverized to have an average particle size of 10 μm. In a mixer available on the market, 500.0 g of polyethylene glycol having a weight average molecular weight of 6000 and 800.0 g of mannitol were added to the above-mentioned fine powder. The resulting mixture was granulated in a stirring granulator available on the market while a 30% by weight solution of covering agents shown in Table 2 was sprayed and dried to completely remove the moisture to have a coating amount of 1.0% by weight based on the total weight of the solid processing agent. Experiment No. 1-1 was not sprayed. Thus, the granular agent was obtained.

Procedure (2)

Hydroxylamine sulfate of 360.0, 40.0 g of potassium bromide and 20.0 g of pyrocatechol-3,5-disodiumsulfonate were pulverized in the same manner as in above Procedure (1). Then, 20.0 g of Pineflow (manufactured by Matsutani Kagaku Co.) were added to the above-mentioned fine powder and mixed in the same manner as in Procedure (1). The resulting mixture was granulated in a fluid bed granulator available on the market while a 30% by weight solution of covering agents shown in Table 2 was added and dried to completely remove the moisture to have a coating amount of 1.0% by weight based on the total weight of the solid agent. Experiment No. 1-1 was not sprayed. Thus, the granular agent was obtained.

Procedure (3)

Color developing agent, CD-3 (4-amino-3-methyl-N-ethyl-β-(hydroxyethyl)aniline sulfate) of 650.0 g was pulverized in the same manner as in above Procedure (1). The resulting powder was granulated in a fluid bed granulator available on the market while a 30% by weight solution of covering agents shown in Table 2 was added and dried to completely remove the moisture to have a coating amount of 1.0% by weight based on the total weight of the solid agent. Experiment No. 1-1 was not sprayed. Thus, the granular agent was obtained.

Procedure (4)

In a cross-rotary mixing machine available on the market were mixed the granules prepared in the above procedures (1) to (3). Thus, the granular solid developing agent for a color negative film was obtained.

(Experiment)

The granular solid developing agent for a color negative film above was evaluated for anti-abrasion property, solubility and storage stability.

a) Anti-abrasion property

The granular solid developing agent for a color negative film was screened with a sieve to remove granules having a particle diameter of not more than 149 μm. The resulting granules of 50 g was packaged in a three direction sealed package made of an aluminium foil laminated with a polyethylene film on the both side. The sealed package was subjected to a vibration test and vibrated for one hour by means of Vibrator BF-UA produced by IDEX Co., Ltd. After the vibration test, the resulting composition was screened with a sieve having a 105 μm screen mesh to remove granules having a particle diameter of not more than 105 μm. After granules having a particle diameter of not more than 105 μm were removed, the weight of granules was measured and the degree of abrasion was calculated by the following equation:

Degree of abrasion (%) =
(total weight of granules before vibration test − total weight of granules after vibration test)/(total weight of granules before vibration test) × 100

Evaluation Criteria

⊙; 0.1% or less

○; 0.1% to less than 1%

Δ; 1% to less than 10%

X; 10% or more b) Solubility

The granular solid developing agent was placed in a net case in an amount of 12 g. The case was placed in 1 liter of the following color developer for a color negative film at 38° C. while stirring with a magnetic stirrer, and then time necessary to completely dissolve the granules was measured.

| Color Developer for Color Negative Film (1 Liter) | |
|---|---|
| Anhydrous potassium carbonate | 29.17 g |
| Sodium sulfite | 4.41 g |
| Pentasodium diethylenetriamine pentaacetate | 2.59 g |
| Polyethylene glycol (weight average molecular weight: 6,000) | 3.80 g |
| Mannitol | 3.04 g |
| Sodium bisulfite | 4.17 g |
| Sodium p-toluenesulfonate | 6.08 g |
| Hydroxylamine sulfate | 2.74 g |
| Potassium bromide | 1.71 g |
| Potassium iodide | 0.004 g |
| Catechol-3,5-disulfonic acid | 0.15 g |
| Pineflow | 0.21 g |
| Sodium N-mirystoylalanine | 0.33 g |
| Color Developing Agent (CD-4) | 4.94 g |

Adjusted with surfuric acid or sodium hydroxide to be pH 10.0.

Evaluation Criteria

⊙; Completely dissolved in less than 30 minutes

○; Completely dissolved in 30 to 60 minutes

Δ; Slight insoluble matter present after 60 minutes

X; Much insoluble matter present and not completely dissolved c) Storage stability (Coloration)

The granular solid developing agent in an amount of 12 g was placed in a polyethylene-made bag and then tightly sealed. The sealed bag was stored for 5 days at 50° C. and 50% RH. After that, the granular agent was evaluated for coloration.

Evaluation Criteria

⊙; No coloration

○; Slight coloration but no problem of commercial value

Δ; Definite coloration and possibility of any change

X; Clear definite coloration and it appears that it cannot be put to practical used.

d) Storage stability (Hygroscopic Property)

The granular solid developing agent in an amount of 12 g was placed in a polyethylene-made dish and stored for 2 days at 50° C. and 50% RH. After that, the weight of the granular agent was measured and moisture absorption coefficient was calculated by the following equation:

Moisture absorption coefficient (%) =
(total weight of granules after storage − total weight of granules before storage)/(total weight of granules before storage) × 100

Evaluation Criteria

*; Less than 0.2

⊙; 0.2 to less than 0.5%

○; 0.5 to less than 1.0%

Δ; 1.0 to less than 2.0%

X; More than 2.0%

The results are shown in Table 2.

TABLE 2

| Experiment No. | Covering Material | Anti-abrasion Property | Solubility | Storage Stability (Coloration) | Moisture Absorption Coefficient |
|---|---|---|---|---|---|
| 1-1 | Not Covered | X | ◎ | X | X |
| 1-2 | Compound (1-2) disodium salt | ○ | ◎ | ○ | ○ |
| 1-3 | Compound (1-7) | ○ | ◎ | ○ | ○ |
| 1-4 | Compound (1-10) | ○ | ◎ | ○ | ○ |
| 1-5 | Compound (1-14) | ○ | ◎ | ○ | ○ |
| 1-6 | Compound (1-20) sodium salt | ○ | ◎ | ○ | ○ |
| 1-7 | Compound (1-38) sodium salt | ○ | ◎ | ○ | ○ |
| 1-8 | Compound (1-56) | ○ | ◎ | ○ | ○ |
| 1-9 | Compound (1-57) sulfuric acid salt | ○ | ○ | ○ | ○ |
| 1-10 | Compound (1-58) oxalic acid salt | ○ | ○ | ○ | ○ |
| 1-11 | Compound (3-2) | ○ | ○ | ○ | ○ |
| 1-12 | Compound (4-1) | ○ | ○ | ○ | ○ |
| 1-13 | $Na_2SO_3$ | ○ | ○ | ○ | ○ |
| 1-14 | Compound (1-7) (3 weight parts)/ PEG 4000 (7 weight parts) | ○ | ◎ | ○ | ◎ |
| 1-15 | Compound (1-7) (3 weight parts)/ Pineflow (7 weight parts) | ○ | ◎ | ○ | ◎ |
| 1-16 | Compound (1-7) (3 weight parts)/ Erythritol (7 weight parts) | ○ | ◎ | ○ | ◎ |
| 1-17 | PEG 4000 (*1) | ○ | X | Δ | Δ |
| 1-18 | Pineflow (*2) | ○ | X | Δ | Δ |
| 1-19 | Erythritol (*3) | ○ | X | Δ | Δ |

(*1) PEG 4000 refers to polyethylene glycol having a weight average molecular weight of 4,000.
(*2) Pineflow refers to dextrin produced by Matsutani Kagaku Co., Ltd.
(*3) Erythritol refers to erythrit produced by Mitsubishikasei Shokuhin Co., Ltd.

As is seen from Table 2, the agent of the invention exhibits improved effects in anti-abrasion, solubility, storage coloration and moisture absorption. The agent further covered with at least one of a water-soluble polymer and saccharide exhibits especially improved effects.

Example 2

A tablet solid processing agent for a color negative film was prepared in the following procedures.

(1) Granulation

Procedure (5)

In a bandamu mill available on the market, 3750.0 g of anhydrous potassium carbonate, 580.0 g of sodium sulfite, 240.0 g of pentasodium diethylene-triamine pentaacetate, 500.0 g of sodium p-toluene sulfonate and 500.0 g of bis(2-sulfoethyl)hydroxylamine disodium were pulverized to have an average particle size of 10 μm. In a mixer available on the market, 500.0 g of polyethylene glycol having a weight average molecular weight of 6000 and 800.0 g of mannitol were added to the above-mentioned fine powder. The resulting mixture was granulated for 7 minutes in a stirring granulator available on the market by adding 160 ml of water and then dried in a fluid-bed type drier available on the market for 120 minutes at 70° C. to substantially remove moisture therefrom.

Procedure (6)

Hydroxylamine sulfate of 360.0, 40.0 g of potassium bromide and 20.0 g of pyrocatechol-3,5-disodiumsulfonate were pulverized in a bandamu mill available on the market to have an average particle size of 10 μm. In a mixer available on the market 20.0 g of Pineflow (produced by Matsutani Kagaku Co., Ltd.) were added to the above-mentioned fine powder and mixed. The resulting mixture was granulated at room temperature for 7 minutes in a stirring granulator available on the market by adding 3.5 ml of water and then dried in a fluid-bed type drier available on the market for 60 minutes at 60° C. to substantially remove moisture.

Procedure (7)

In a bandamu mill available on the market 650.0 g of color developing agent CD-4 (4-amino-3-methyl-N-ethyl-β-(hydroxyethyl)aniline sulfate) were pulverized to have an average particle size of 10 μm. The resulting powder was granulated at room temperature for 7 minutes in a stirring granulator available on the market by adding 10 ml of water and then dried in a fluid-bed type drier available on the market for 2 hours at 40° C. to substantially remove moisture.

Procedure (8)

In a cross-rotary mixing machine available on the market were mixed the granules prepared in the above procedures (5) to (7) and 40 g of sodium N-mirystoylalanine was added and mixed for 3 minutes. The resulting mixture was tableted by using a rotary tableting machine (Clean Press Correct H18 manufactured by Kikusui Mfg. Works).

(A) Preparation of color developing tablet A for color negative film use.

The mixture prepared in Procedures (5) to (8) above was tableted at a tableting compression of 7 t by using a rotary tableting machine (Clean Press Correct H18 manufactured by Kikusui Mfg. Works). Thus, 900 pieces of tablets each having a diameter of 30 mm, a thickness of 10 mm and a weight of 10.5 g were obtained as replenishing color developing tablets for color negative film use. The shape of these solid tablets is illustrated in FIG. 1(A).

(B) Preparation of color developing tablet B for color negative film use.

Covering agents and/or additives shown in Table 3 were dissolved in water to prepare a 30 weight % solution or dispersion. The adding amount of the additives to the covering agents are as shown in the Table. The solution was sprayed on upper and lower surfaces of the above described tablet A with an air spraying nozzle available on the market and promptly dried with a 50° to 55° C. air. This procedure was repeated to cover the upper and lower surfaces of the tablet. The coating was carried out adjusting a spraying amount and spraying time of the solution to have a coating amount of 1.0% by weight based on the total weight of the solid processing agent. Thus, replenishing color developing tablet B for color negative film use was obtained. The shape of this solid tablet is illustrated in FIG. 1(B).

(C) Preparation of color developing tablet C for color negative film use.

Covering agents and additives shown in Table were dissolved in water to prepare a 30 weight % solution or dispersion. The adding amount of the additives to the covering agents are as shown in Table. In an aqua-coater AQC-48T Type produced by Froint Co., Ltd. 5.0 kg of the above tablet A were placed. After preheated with a supplying air of about 60° C., the rotation frequency of the pan was set to 15 rpm. Adjusting a supplying air to be 60°–65° C. and a discharging air to be 35°–40° C., the solution was sprayed at a spraying pressure of 4 kg/cm$^2$ and in a spraying amount of 4 g/mm. The coating was carried out varying a spraying time to have a coating amount of 1.0% by weight based on the total weight of the solid processing agent. Thus, replenishing color developing tablet C for color negative film use was obtained. The shape of this solid tablet is illustrated in FIG. 1(C).

(Experiment)

The color developing tablets A–C for color negative film use above were evaluated for anti-abrasion property, solubility and storage coloration.

a) Anti-abrasion property

The five tablets preweighed were placed in an abrasion degree tester produced by Kayagaki Rikakogyo Co., Ltd. which was modified and rotated for 5 minutes. The total weight of the tablets after the test was measured and the degree of abrasion was calculated by the following equation:

Degree of abrasion (%) =
(total weight of tablets before test − total weight of tablets after test)/(total weight of tablets before test) × 100

Evaluation Criteria

⊙; 0.1% or less

○; 0.1% to less than 1.0%

Δ; 1.0% to less than10%

X; 10% or more b) Solubility

The one tablet was placed in a net case. The case was placed in 1 liter of the following color developer for a color negative film at 38° C. while stirring with a magnetic stirrer and the time necessary to completely dissolve the tablet was measured.

| Color Developer for Color Negative Film (1 Liter) | |
|---|---|
| Anhydrous potassium carbonate | 29.17 g |
| Sodium sulfite | 4.41 g |
| Pentasodium diethylenetriamine pentaacetate | 2.59 g |
| Polyethylene glycol (weight average molecular weight: 6,000) | 3.80 g |
| Mannitol | 3.04 g |
| Sodium bisulfite | 4.17 g |

-continued

| Color Developer for Color Negative Film (1 Liter) | |
|---|---|
| Sodium p-toluenesulfonate | 6.08 g |
| Hydroxylamine sulfate | 2.74 g |
| Potassium bromide | 1.71 g |
| Potassium iodide | 0.004 g |
| Catechol-3,5-disulfonic acid | 0.15 g |
| Pineflow | 0.21 g |
| Sodium N-mirystoylalanine | 0.33 g |
| Color Developing Agent (CD-4) | 4.94 g |

Adjusted with surfuric acid or sodium hydroxide to be pH 10.0.

Evaluation Criteria

⊙; Completely dissolved in not more than 30 minutes

○; Completely dissolved in 30 to 60 minutes

Δ; Slight insoluble matter present after 60 minutes

X; Much insoluble matter present and not completely dissolved c) Storage stability (Coloration)

The two hundred tablets were placed in a polyethylene-made bag and then heat-sealed. The sealed bag was stored for 5 days at 50° C. and 50% RH. After that, the tablets were evaluated for coloration.

Evaluation Criteria

⊙; No coloration

○; Slight coloration but no problem of commercial value

Δ; Definite coloration and possibility of any change

X; Clear definite coloration and problem of commercial value d) Storage stability (Hygroscopic Property)

The tablets were placed in a polyethylene-made dish and stored for 2 days at 50° C. and 50% RH. After that, the thickness of the tablets was measured and moisture absorption coefficient was calculated by the following equation:

Moisture absorption expansion coefficient (%) =
(thickness of tablets after storage − thickness of tablets before storage)/(thickness of tablets before storage) × 100

Evaluation Criteria

*; Less than 0.2

⊙; 0.2 to less than 0.5%

○; 0.5 to less than 1.0%

Δ; 1.0 to less than 2.0%

X; More than 2.0%

The results are shown in Table 3.

TABLE 3

| Experiment No. | Type | Covering Material | Anti-abrasion Property | Solubility | Storage Stability (Coloration) | Moisture Absorption Expansion Coefficient |
|---|---|---|---|---|---|---|
| 2-1 | A | Not Covered | X | ⊙ | X | X |
| 2-2 | C | Compound (1-2) disodium salt | ○ | ⊙ | ⊙ | ⊙ |
| 2-3 | C | Compound (1-7) | ○ | ⊙ | ⊙ | ⊙ |
| 2-4 | C | Compound (1-10) | ○ | ○ | ○ | ○ |
| 2-5 | C | Compound (1-14) | ○ | ⊙ | ⊙ | ○ |
| 2-6 | C | Compound (1-20) sodium salt | ○ | ⊙ | ○ | ⊙ |
| 2-7 | C | Compound (1-38) | ○ | ⊙ | ○ | ⊙ |

TABLE 3-continued

| Experiment No. | Type | Covering Material | Anti-abrasion Property | Solubility | Storage Stability (Coloration) | Moisture Absorption Expansion Coefficient |
|---|---|---|---|---|---|---|
| | | sodium salt | | | | |
| 2-8 | C | Compound (1-56) | ○ | ○ | ○ | ◎ |
| 2-9 | C | Compound (1-57) sulfuric acid salt | ○ | ○ | ○ | ○ |
| 2-10 | C | Compound (1-58) oxalic acid salt | ○ | ○ | ○ | ○ |
| 2-11 | C | Compound (3-2) | ○ | ○ | ◎ | ○ |
| 2-12 | C | Compound (4-1) | ○ | ○ | ○ | ○ |
| 2-13 | C | $Na_2SO_3$ | ○ | ○ | ○ | ○ |
| 2-14 | C | Compound (1-7) (3 weight parts)/ PEG 4000 (7 weight parts) | ○ | ◎ | ◎ | * |
| 2-15 | C | Compound (1-7) (3 weight parts)/ Pineflow (7 weight parts) | ○ | ◎ | ◎ | * |
| 2-16 | C | Compound (1-7) (3 weight parts)/ Erythritol (7 weight parts) | ○ | ◎ | ◎ | * |
| 2-17 | B | Compound (1-7) | ○ | ◎ | ○ | ○ |
| 2-18 | B | Compound (1-7) (3 weight parts)/ PEG 4000 (7 weight parts) | ○ | ◎ | ◎ | ○ |
| 2-19 | C | PEG 4000 | ○ | X | Δ | Δ |
| 2-20 | C | Pineflow | ○ | X | Δ | Δ |
| 2-21 | C | Erythritol | ○ | X | Δ | Δ |

As is seen from Table, the agent of the invention exhibits improved effects in anti-abrasion, solubility, storage coloration and moisture absorption. The agent further covered with at least one of a water-soluble polymer and saccharide exhibits especially improved effects.

Example 3

Experiment was carried out in the same manner as in Example 2, except that the coating method was C in Example 2, exemplified compound (1-7) was used as a covering material and the coating amount was varied as shown in Table 4. The results are shown in Table 4.

TABLE 4

| Experiment No. | Coating Amount (weight %) | Anti-abrasion Property | Solubility | Storage Stability (Coloration) | Moisture Absorption Expansion Coefficient |
|---|---|---|---|---|---|
| 3-1 | 0 | X | ◎ | X | X |
| 3-2 | 0.01 | Δ | ◎ | Δ | Δ |
| 3-3 | 0.05 | ○ | ◎ | ○ | ○ |
| 3-4 | 0.1 | ○ | ◎ | ◎ | ◎ |
| 3-5 | 0.2 | ○ | ◎ | ◎ | ◎ |
| 3-6 | 1.0 | ○ | ◎ | ◎ | ◎ |
| 3-7 | 2.0 | ○ | ◎ | ◎ | ◎ |

TABLE 4-continued

| Experiment No. | Coating Amount (weight %) | Anti-abrasion Property | Solubility | Storage Stability (Coloration) | Moisture Absorption Expansion Coefficient |
|---|---|---|---|---|---|
| 3-8 | 5.0 | ○ | ○ | ○ | ◎ |
| 3-9 | 7.0 | Δ | Δ | Δ | Δ |

As is seen from Table 4, the sample having a coating amount of not less than 0.05 weight % (particularly not less than 0.02 weight %) exhibits improved effects in anti-abrasion, solubility, storage coloration and moisture absorption. The sample having a coating amount of not more than 0.05 weight % (particularly not more than 0.02 weight %) also exhibits improved effects in anti-abrasion, solubility, storage coloration and moisture absorption.

Example 4

Experiment was carried out in the same manner as in Example 2, except that the coating method was C in Example 2, and a covering material and the coating amount was varied as shown in the following Table. The results are shown in the following Table.

TABLE 5

| Experiment No. | Type | Covering Material: Covering Agent | Covering Material: Additive | Weight ratio of Additive to Covering Agent | Coating Amount (%) | Anti-abrasion Property | Solubility | Storage Stability (Coloration) | Moisture Absorption Expansion Coefficient |
|---|---|---|---|---|---|---|---|---|---|
| 4-1 | A | — | — | — | 0 | X | ◎ | X | X |
| 4-2 | C | PEG4000(*1) | — | 0 | 1.0 | ○ | X | X | X |
| 4-3 | C | PEG4000(*1) | Compound (1-2) disodium salt | 0.3 | 1.0 | ○ | ○ | ◎ | * |
| 4-4 | C | PEG4000(*1) | Compound (1-7) | 0.3 | 1.0 | ○ | ◎ | ◎ | * |
| 4-5 | C | PEG4000(*1) | Compound (1-10) | 0.3 | 1.0 | ○ | ◎ | ○ | ◎ |
| 4-6 | C | PEG4000(*1) | Compound (1-11) | 0.3 | 1.0 | ○ | ○ | ○ | ◎ |
| 4-7 | C | PEG4000(*1) | Compound (1-13) tetrasodium salt | 0.3 | 1.0 | ○ | ◎ | ◎ | * |
| 4-8 | C | PEG4000(*1) | Compound (1-14) sodium salt | 0.3 | 1.0 | ○ | ◎ | ◎ | * |
| 4-9 | C | PEG4000(*1) | Compound (1-20) sodium salt | 0.3 | 1.0 | ○ | ○ | ○ | ◎ |
| 4-10 | C | PEG4000(*1) | Compound (1-24) sodium salt | 0.3 | 1.0 | ○ | ○ | ○ | ◎ |
| 4-11 | C | PEG4000(*1) | Compound (1-26) | 0.3 | 1.0 | ○ | ○ | ◎ | ◎ |
| 4-12 | C | PEG4000(*1) | Compound (1-38) sodium salt | 0.3 | 1.0 | ○ | ○ | ○ | ◎ |

TABLE 6

| Experiment No. | Type | Covering Material: Covering Agent | Covering Material: Additive | Weight ratio of Additive to Covering Agent | Coating Amount (%) | Anti-abrasion Property | Solubility | Storage Stability (Coloration) | Moisture Absorption Expansion Coefficient |
|---|---|---|---|---|---|---|---|---|---|
| 4-13 | B | PEG4000(*1) | Compound (1-47) sodium salt | 0.3 | 1.0 | ○ | ○ | ◎ | * |
| 4-14 | B | PEG4000(*1) | Compound (1-56) | 0.3 | 1.0 | ○ | ○ | ◎ | * |
| 4-15 | C | PEG4000(*1) | Compound (1-57) sulfuric acid salt | 0.3 | 1.0 | ○ | ○ | ○ | ○ |
| 4-16 | C | PEG4000(*1) | Compound (1-58) oxalic acid salt | 0.3 | 1.0 | ○ | ○ | ○ | ○ |
| 4-17 | C | PEG4000(*1) | Compound (3-2) | 0.3 | 1.0 | ○ | ◎ | ◎ | * |
| 4-18 | C | PEG4000(*1) | Compound (3-8) | 0.3 | 1.0 | ○ | ○ | ◎ | ◎ |
| 4-19 | C | PEG4000(*1) | Compound (3-11) | 0.3 | 1.0 | ○ | ○ | ◎ | ◎ |
| 4-20 | C | PEG4000(*1) | Compound (4-1) | 0.3 | 1.0 | ○ | ○ | ◎ | ◎ |
| 4-21 | C | PEG4000(*1) | Compound (4-4) | 0.3 | 1.0 | ○ | ○ | ◎ | ◎ |
| 4-22 | C | PEG4000(*1) | Compound (4-6) | 0.3 | 1.0 | ○ | ○ | ◎ | ◎ |
| 4-23 | C | PEG4000(*1) | $K_2SO_3$ | 0.3 | 1.0 | ○ | ○ | ○ | ◎ |
| 4-24 | C | PEG4000(*1) | $Na_2SO_3$ | 0.3 | 1.0 | ○ | ○ | ○ | ◎ |

TABLE 7

| Experiment No. | Type | Covering Material: Covering Agent | Covering Material: Additive | Weight ratio of Additive to Covering Agent | Coating Amount (%) | Anti-abrasion Property | Solubility | Storage Stability (Coloration) | Moisture Absorption Expansion Coefficient |
|---|---|---|---|---|---|---|---|---|---|
| 4-25 | C | Compound (B-3) | — | 0.3 | 1.0 | ○ | X | X | X |
| 4-26 | C | Compound (B-3) | Compound (1-2) sodium salt | 0.3 | 1.0 | ○ | ○ | ◎ | ◎ |
| 4-27 | C | Compound (B-3) | Compound (1-7) | 0.3 | 1.0 | ◎ | ○ | ◎ | * |

TABLE 8

| Experiment No. | Type | Covering Material: Covering Agent | Covering Material: Additive | Weight ratio of Additive to Covering Agent | Coating Amount (%) | Anti-abrasion Property | Solubility | Storage Stability (Coloration) | Moisture Absorption Expansion Coefficient |
|---|---|---|---|---|---|---|---|---|---|
| 4-28 | C | Compound (B-3) | Compound (1-57) surfuric acid salt | 0.3 | 1.0 | ○ | ○ | ◎ | ○ |
| 4-29 | C | Compound (B-3) | Compound (1-18) oxalic acid salt | 0.3 | 1.0 | ○ | ○ | ○ | ○ |
| 4-30 | C | Compound (B-3) | Compound (3-2) | 0.3 | 1.0 | ◎ | ○ | ◎ | * |
| 4-31 | C | Compound (B-3) | Compound (3-8) | 0.3 | 1.0 | ○ | ○ | ◎ | ◎ |
| 4-32 | C | Compound (B-3) | Compound (3-11) | 0.3 | 1.0 | ◎ | ○ | ○ | ◎ |
| 4-33 | C | Compound (B-3) | Compound (4-1) | 0.3 | 1.0 | ◎ | ○ | ○ | ○ |
| 4-34 | C | Compound (B-3) | Compound (4-4) | 0.3 | 1.0 | ○ | ○ | ◎ | ◎ |
| 4-35 | C | Compound (B-3) | Compound (4-6) | 0.3 | 1.0 | ○ | ○ | ○ | ◎ |
| 4-36 | C | Compound (B-3) | $K_2SO_3$ | 0.3 | 1.0 | ○ | ○ | ○ | ○ |
| 4-37 | C | Compound (B-3) | $Na_2SO_3$ | 0.3 | 1.0 | ○ | ○ | ○ | ○ |

TABLE 9

| Experiment No. | Type | Covering Material: Covering Agent | Covering Material: Additive | Weight ratio of Additive to Covering Agent | Coating Amount (%) | Anti-abrasion Property | Solubility | Storage Stability (Coloration) | Moisture Absorption Expansion Coefficient |
|---|---|---|---|---|---|---|---|---|---|
| 4-38 | C | Pineflow(*2) | — | 0 | 1.0 | ○ | X | X | X |
| 4-39 | B | Pineflow(*2) | Compound (1-2) disodium salt | 0.3 | 1.0 | ○ | ○ | ○ | ◎ |
| 4-40 | B | Pineflow(*2) | Compound (1-7) | 0.3 | 1.0 | ○ | ◎ | ○ | * |
| 4-41 | C | Pineflow(*2) | Compound (1-57) surfuric acid salt | 0.3 | 1.0 | ○ | ○ | ○ | ○ |
| 4-42 | C | Pineflow(*2) | Compound (1-58) oxalic acid salt | 0.3 | 1.0 | ○ | ○ | ○ | ○ |
| 4-43 | C | Pineflow(*2) | Compound (3-2) | 0.3 | 1.0 | ○ | ○ | ○ | ◎ |
| 4-44 | C | Pineflow(*2) | Compound (3-8) | 0.3 | 1.0 | ○ | ○ | ○ | ○ |
| 4-45 | C | Pineflow(*2) | Compound (3-11) | 0.3 | 1.0 | ○ | ○ | ○ | ○ |
| 4-46 | C | Pineflow(*2) | Compound (4-1) | 0.3 | 1.0 | ○ | ○ | ○ | ◎ |
| 4-47 | C | Pineflow(*2) | Compound (4-4) | 0.3 | 1.0 | ○ | ○ | ○ | ○ |
| 4-48 | B | Pineflow(*2) | Compound (4-6) | 0.3 | 1.0 | ○ | ○ | ◎ | ○ |
| 4-49 | B | Pineflow(*2) | $Na_2SO_3$ | 0.3 | 1.0 | ○ | ○ | ○ | ○ |

TABLE 10

| Experiment No. | Type | Covering Material: Covering Agent | Covering Material: Additive | Weight ratio of Additive to Covering Agent | Coating Amount (%) | Anti-abrasion Property | Solubility | Storage Stability (Coloration) | Moisture Absorption Expansion Coefficient |
|---|---|---|---|---|---|---|---|---|---|
| 4-50 | C | Erithritol(*3) | — | 0 | 1.0 | Δ | X | X | X |
| 4-51 | C | Erithritol(*3) | Compound (1-2) disodium salt | 0.3 | 1.0 | ○ | ○ | ○ | ◎ |
| 4-52 | C | Erithritol(*3) | Compound (1-7) | 0.3 | 1.0 | ○ | ◎ | ○ | * |
| 4-53 | C | Erithritol(*3) | Compound (1-57) surfuric acid salt | 0.3 | 1.0 | ○ | ○ | ○ | ○ |
| 4-54 | C | Erithritol(*3) | Compound (1-58) oxalic acid salt | 0.3 | 1.0 | ○ | ○ | ○ | ○ |
| 4-55 | C | Erithritol(*3) | Compound (3-2) | 0.3 | 1.0 | ○ | ○ | ○ | ◎ |
| 4-56 | C | Erithritol(*3) | Compound (3-8) | 0.3 | 1.0 | ○ | ○ | ○ | ○ |
| 4-57 | C | Erithritol(*3) | Compound (3-11) | 0.3 | 1.0 | ○ | ○ | ○ | ○ |
| 4-58 | C | Erithritol(*3) | Compound (4-1) | 0.3 | 1.0 | ○ | ○ | ○ | ◎ |
| 4-59 | C | Erithritol(*3) | Compound (4-4) | 0.3 | 1.0 | ○ | ○ | ○ | ○ |

TABLE 10-continued

| Experiment No. | Type | Covering Material: Covering Agent | Covering Material: Additive | Weight ratio of Additive to Covering Agent | Coating Amount (%) | Anti-abrasion Property | Solubility | Storage Stability (Coloration) | Moisture Absorption Expansion Coefficient |
|---|---|---|---|---|---|---|---|---|---|
| 4-60 | B | Erithritol(*3) | Compound (4-6) | 0.3 | 1.0 | ○ | ○ | ◎ | ○ |
| 4-61 | B | Erithritol(*3) | $Na_2SO_3$ | 0.3 | 1.0 | ○ | ○ | ○ | ◎ |

TABLE 11

| Experiment No. | Type | Covering Material: Covering Agent | Covering Material: Additive | Weight ratio of Additive to Covering Agent | Coating Amount (%) | Anti-abrasion Property | Solubility | Storage Stability (Coloration) | Moisture Absorption Expansion Coefficient |
|---|---|---|---|---|---|---|---|---|---|
| 4-62 | C | PEG4000 | — | 0 | 0.05 | ○ | X | X | X |
| 4-63 | C | PEG4000 | Compound (1-7) | 0.05 | 0.05 | ○ | ○ | Δ | ○ |
| 4-64 | C | PEG4000 | Compound (1-7) | 0.1 | 0.05 | ○ | ○ | ○ | ○ |
| 4-65 | C | PEG4000 | Compound (1-7) | 0.3 | 0.05 | ○ | ◎ | ◎ | |
| 4-66 | C | PEG4000 | Compound (1-7) | 0.5 | 0.05 | ○ | ◎ | ◎ | ◎ |
| 4-67 | C | PEG4000 | Compound (1-7) | 0.7 | 0.05 | ○ | ◎ | ◎ | ◎ |
| 4-68 | C | PEG4000 | Compound (1-7) | 1.0 | 0.05 | ○ | ○ | ○ | ○ |
| 4-69 | C | PEG4000 | Compound (1-7) | 2.0 | 0.05 | ○ | Δ | ○ | ○ |
| 4-70 | C | PEG4000 | Compound (1-7) | 3.0 | 0.05 | ○ | Δ | ○ | ○ |

TABLE 12

| Experiment No. | Type | Covering Material: Covering Agent | Covering Material: Additive | Weight ratio of Additive to Covering Agent | Coating Amount (%) | Anti-abrasion Property | Solubility | Storage Stability (Coloration) | Moisture Absorption Expansion Coefficient |
|---|---|---|---|---|---|---|---|---|---|
| 4-71 | C | PEG4000 | — | 0 | 0.05 | ○ | X | X | X |
| 4-72 | C | PEG4000 | Compound (3-2) | 0.05 | 0.05 | ○ | ○ | Δ | ○ |
| 4-73 | C | PEG4000 | Compound (3-2) | 0.1 | 0.05 | ○ | ○ | ○ | ○ |
| 4-74 | C | PEG4000 | Compound (3-2) | 0.3 | 0.05 | ○ | ◎ | ○ | ◎ |
| 4-75 | C | PEG4000 | Compound (3-2) | 0.5 | 0.05 | ○ | ◎ | ○ | ◎ |
| 4-76 | C | PEG4000 | Compound (3-2) | 0.7 | 0.05 | ○ | ◎ | ◎ | ◎ |
| 4-77 | C | PEG4000 | Compound (3-2) | 1.0 | 0.05 | ○ | ○ | ○ | ○ |
| 4-78 | C | PEG4000 | Compound (3-2) | 2.0 | 0.05 | ○ | Δ | ○ | ○ |
| 4-79 | C | PEG4000 | Compound (3-2) | 3.0 | 0.05 | ○ | Δ | ○ | ○ |

TABLE 13

| Experiment No. | Type | Covering Material: Covering Agent | Covering Material: Additive | Weight ratio of Additive to Covering Agent | Coating Amount (%) | Anti-abrasion Property | Solubility | Storage Stability (Coloration) | Moisture Absorption Expansion Coefficient |
|---|---|---|---|---|---|---|---|---|---|
| 4-80 | C | PEG4000 | — | 0 | 0.05 | ○ | X | X | X |
| 4-81 | C | PEG4000 | Compound (4-2) | 0.05 | 0.05 | ○ | ○ | Δ | ○ |

TABLE 13-continued

| Experiment No. | Type | Covering Material: Covering Agent | Covering Material: Additive | Weight ratio of Additive to Covering Agent | Coating Amount (%) | Anti-abrasion Property | Solubility | Storage Stability (Coloration) | Moisture Absorption Expansion Coefficient |
|---|---|---|---|---|---|---|---|---|---|
| 4-82 | C | PEG4000 | Compound (4-2) | 0.1 | 0.05 | ○ | ○ | ○ | ○ |
| 4-83 | C | PEG4000 | Compound (4-2) | 0.3 | 0.05 | ○ | ○ | ◎ | ◎ |
| 4-84 | C | PEG4000 | Compound (4-2) | 0.5 | 0.05 | ○ | ○ | ◎ | ◎ |
| 4-85 | C | PEG4000 | Compound (4-2) | 0.7 | 0.05 | ○ | ◎ | ◎ | ◎ |
| 4-86 | C | PEG4000 | Compound (4-2) | 1.0 | 0.05 | ○ | ○ | ○ | ○ |
| 4-87 | C | PEG4000 | Compound (4-2) | 2.0 | 0.05 | ○ | Δ | ○ | ○ |
| 4-88 | C | PEG4000 | Compound (4-2) | 3.0 | 0.05 | ○ | Δ | ○ | ○ |

TABLE 14

| Experiment No. | Type | Covering Material: Covering Agent | Covering Material: Additive | Weight ratio of Additive to Covering Agent | Coating Amount (%) | Anti-abrasion Property | Solubility | Storage Stability (Coloration) | Moisture Absorption Expansion Coefficient |
|---|---|---|---|---|---|---|---|---|---|
| 4-89 | C | PEG4000 | — | 0 | 0.05 | ○ | X | X | X |
| 4-90 | C | PEG4000 | $Na_2SO_3$ | 0.05 | 0.05 | ○ | ○ | ○ | ○ |
| 4-91 | C | PEG4000 | $Na_2SO_3$ | 0.1 | 0.05 | ○ | ○ | ○ | ○ |
| 4-92 | C | PEG4000 | $Na_2SO_3$ | 0.3 | 0.05 | ○ | ○ | ○ | ◎ |
| 4-93 | C | PEG4000 | $Na_2SO_3$ | 0.5 | 0.05 | ○ | ○ | ◎ | ◎ |
| 4-94 | C | PEG4000 | $Na_2SO_3$ | 0.7 | 0.05 | ○ | ◎ | ◎ | ◎ |
| 4-95 | C | PEG4000 | $Na_2SO_3$ | 1.0 | 0.05 | ○ | ○ | ○ | ○ |
| 4-96 | C | PEG4000 | $Na_2SO_3$ | 2.0 | 0.05 | ○ | ○ | ○ | ○ |
| 4-97 | C | PEG4000 | $Na_2SO_3$ | 3.0 | 0.05 | ○ | ○ | ○ | ○ |

TABLE 15

| Experiment No. | Type | Covering Material: Covering Agent | Covering Material: Additive | Weight ratio of Additive to Covering Agent | Coating Amount (%) | Anti-abrasion Property | Solubility | Storage Stability (Coloration) | Moisture Absorption Expansion Coefficient |
|---|---|---|---|---|---|---|---|---|---|
| 4-98 | C | PEG4000 | — | 0.3 | 0.01 | Δ | ○ | ○ | Δ |
| 4-99 | C | PEG4000 | Compound (1-7) | 0.3 | 0.05 | ○ | ○ | ○ | ○ |
| 4-100 | C | PEG4000 | Compound (1-7) | 0.3 | 0.1 | ○ | ○ | ○ | ◎ |
| 4-101 | C | PEG4000 | Compound (1-7) | 0.3 | 0.2 | ○ | ◎ | ◎ | * |
| 4-102 | C | PEG4000 | Compound (1-7) | 0.3 | 1.0 | ○ | ◎ | ◎ | * |
| 4-103 | C | PEG4000 | Compound (1-7) | 0.3 | 2.0 | ○ | ◎ | ◎ | * |
| 4-104 | C | PEG4000 | Compound (1-7) | 0.3 | 5.0 | ○ | ○ | ○ | ◎ |
| 4-105 | C | PEG4000 | Compound (1-7) | 0.3 | 7.0 | ○ | Δ | ○ | ○ |
| 4-106 | C | PEG4000 | Compound (1-7) | 0.3 | 10.0 | ○ | Δ | ○ | ○ |

As is seen from the above Tables, the solid processing agent of the invention exhibits improved effects in anti-abrasion, solubility, storage coloration and moisture absorption. The agent of C type whose surface is entirely covered exhibits especially improved effects. It has been found that when the weight ratio of a compound represented by Formula (1), (2), (3) or (4) or a sulfite to a covering agent is 0.1 to 1, the invention is especially effected. The process using the solid processing agent of the invention is photographically stable.

Example 5

A tablet solid processing agent for a color negative film was prepared in the same manner as in Example 2, except that a covering agent as shown in the following Table was used instead of the covering agent used in Experiment No. 4-4 and evaluated in the same manner as in Example 2. The results are shown in Table below.

TABLE 16

| Experiment No. | Covering Agent | Anti-abrasion Property | Solubility | Storage Stability (Coloration) | Moisture Absorption Expansion Coefficient |
|---|---|---|---|---|---|
| 5-1 | Polyethylene glycol having an weight average molecular weight of 2000 | ○ | ◎ | ◎ | ◎ |
| 5-2 (4-4) | Polyethylene glycol having an weight average molecular weight of 4000 | ○ | ◎ | ◎ | * |
| 5-3 | Polyethylene glycol having an weight average molecular weight of 6000 | ◎ | ◎ | ◎ | * |
| 5-4 | Polyethylene glycol having an weight average molecular weight of 8000 | ◎ | ◎ | ◎ | * |
| 5-5 | Polyethylene glycol having an weight average molecular weight of 10000 | ◎ | ○ | ◎ | * |
| 5-6 | Polypropylene glycol having an weight average molecular weight of 4000 | ○ | ◎ | ◎ | ◎ |
| 5-7 | Polypropylene glycol having an weight average molecular weight of 6000 | ◎ | ○ | ◎ | ◎ |
| 5-8 | Polypropylene glycol having an weight average molecular weight of 8000 | ◎ | ○ | ◎ | ◎ |

TABLE 17

| Experiment No. | Covering Agent | Anti-abrasion Property | Solubility | Storage Stability (Coloration) | Moisture Absorption Expansion Coefficient |
|---|---|---|---|---|---|
| 5-9 | Yuka Former AM-75W(*4) | ◎ | ◎ | ◎ | * |
| 5-10 | Yuka Former AM-75, 501(*5) | ◎ | ◎ | ◎ | * |
| 5-11 | Compound (B-1) | ◎ | ◎ | ○ | ◎ |
| 5-12 | Compound (B-2) | ◎ | ◎ | ○ | ◎ |
| 5-13 | Compound (B-4) | ◎ | ◎ | ○ | ◎ |
| 5-14 | Compound (B-5) | ◎ | ◎ | ○ | ◎ |
| 5-15 | Compound (B-6) | ◎ | ◎ | ○ | ◎ |
| 5-16 | Compound (B-7) | ◎ | ◎ | ○ | ◎ |

TABLE 18

| Experiment No. | Covering Agent | Anti-abrasion Property | Solubility | Storage Stability (Coloration) | Moisture Absorption Expansion Coefficient |
|---|---|---|---|---|---|
| 5-17 | Eudragid L30D55(*6) | ○ | ◎ | ○ | ◎ |
| 5-18 | Hydroxypropylcellulose having an weight average molecular weight of 1000 | ○ | ○ | ○ | ○ |
| 5-19 | Hydroxypropylcellulose having an weight average molecular weight of 5000 | ○ | ○ | ○ | ◎ |
| 5-20 | Hydroxypropylmethylcellulose having an weight average molecular weight of 1000 | ○ | ○ | ○ | ○ |
| 5-21 | Hydroxypropylmethylcellulose having an weight average molecular weight of 5000 | ◎ | ○ | ○ | ◎ |
| 5-22 | Pineflow(*7) | ◎ | ◎ | ○ | * |
| 5-23 | Pinedex | ◎ | ○ | ○ | ◎ |
| 5-24 | Anhydrous maltose | ◎ | ○ | ○ | ○ |
| 5-25 | Erythritol | ◎ | ◎ | ○ | * |
| 5-26 | Lactose | ○ | ○ | ○ | ○ |

(*4)Yuka Former AM-75W refers to a betaine type acrylic acid-acrylic acid copolymer produced by Mitsubishi Yuka Co., Ltd.
(*5)Yuka Former AM-75, 501 refers to a betaine type acrylic acid-acrylic acid copolymer produced by Mitsubishi Yuka Co., Ltd.
(*6)Eudragid L30D55 refers to a acrylic acid-methylacrylate copolymer produced by Leapharma Co., Ltd.
(*7)Pineflow refers to dextrin produced by Matsutani Kagaku Co., Ltd.
(*8)Pinedex refers to dextrin produced by Matsutani Kagaku Co., Ltd.

As is seen from The above Tables, if the covering agent is changed, the invention is sufficiently effected. Particularly, polyethylene glycol having having an weight average molecular weight of 4000 to 8000 or Yuka Former AM-75W or Yuka Former AM-75, 501 (produced by Mitsubishi Yuka Co., Ltd.) gives an excellent results.

Example 6

A granular solid processing agent for a color paper was prepared in the following procedures.

Procedure (9)

In a bandamu mill available on the market 1500.0 g of color developing agent CD-3 (4-amino-3-methyl-N-ethyl-N-β-(methanesulfonamido)ethylaniline sulfate) were pulverized to have an average particle size of 10 μm. The resulting powder was mixed with 1000.0 g of polyethylene glycol having an weight average molecular weight of 6000 in a mixer available on the market. The resulting mixture was covered with a covering material shown in Table 19 (except for Experiment No. 6-1) in a fluid-bed type granulator available on the market to have a coating amount of 1.0% by weight based on the total weight of the solid agent while spraying a 30 weight % solution of the covering material and dried to substantially remove the moisture and to obtain granules.

Procedure (10)

In the same manner as in Procedure (11), 400.0 g of bis(sulfoethyl)hydroxylamine disodium salt, 1700.0 g of sodium p-toluene sulfonate and 300.0 g of Tinopar (produced by Ciba-Geigy Co., Ltd.) were individually pulverized. In a mixer available on the market, 240.0 g of Pineflow (produced by Matsutani Kagaku Co., Ltd.) were added to the above-mentioned fine powder. The resulting mixture was covered with a covering material shown in Table 19 (except for Experiment No. 6-1) in a fluid-bed type granulator available on the market to have a coating amount of 1.0% by weight based on the total weight of the solid material while spraying a 30 weight % solution of the covering agent and dried to substantially remove the moisture and to obtain granules.

Procedure (11)

In the same manner as in Procedure (11), 330.0 g of pentasodium diethylene-triamine pentaacetate, 130.0 g of sodium p-toluene sulfonate, 37.0 g of sodium sulfite, 340.0 g of lithium hydroxide monohydrate and 3300.0 g of anhydrous potassium carbonate were pulverized. In a mixer available on the market, 500.0 g of polyethylene glycol having a weight average molecular weight of 6000 and 600.0 g of mannitol were added to the above-mentioned fine powder at not more than 40% RH. The resulting mixture was covered with a covering material shown in Table 19 (except for Experiment No. 6-1) in a fluid-bed type granulator available on the market to have a coating amount of 1.0% by weight based on the total weight of the solid agent while spraying a 30 weight % solution of the covering material and dried to substantially remove the moisture and to obtain granules.

Procedure (12)

In a cross-rotary mixing machine available on the market were mixed the granules prepared in the above procedures (9) to (11) for 10 minutes. Thus, a granular solid processing agent for a color paper was obtained.

(Experiment)

The above obtained agent was evaluated for anti-abrasion property, storage stability (Coloration) and storage moisture absorption in the same manner as in Example 1 and the solubility was evaluated using the following solution.

| Color Developer for Color Paper (1 Liter) | |
|---|---|
| Bis(sulfoethyl)hydroxylamine disodium salt | 4.0 g |
| Sodium p-toluenesulfonate | 15.0 g |
| Tinopar (produced by Ciba-Geigy Co., Ltd.) | 3.0 g |
| Diethylenetriamine pentaacetic acid | 2.5 g |
| Potassium chloride | 3.5 g |
| Sodium sulfite | 0.2 g |
| Anhydrous potassium carbonate | 30.0 g |
| Pineflow | 15 g |
| Polyethylene glycol (weight average molecular weight: 4,000) | 5.0 g |
| Color developing agent (CD-3) | 6.5 g |

Adjusted with surfuric acid or sodium hydroxide to be pH 10.0.

The results are shown in Table 19.

TABLE 19

| Experiment No. | Covering Material | Anti-abrasion Property | Solubility | Storage Stability (Coloration) | Moisture Absorption Coefficient |
|---|---|---|---|---|---|
| 6-1 | — | x | ◎ | x | x |
| 6-2 | Compound (1-2) disodium salt | ○ | ◎ | ○ | ○ |
| 6-3 | Compound (1-7) | ○ | ◎ | ○ | ○ |
| 6-4 | Compound (1-10) | ○ | ◎ | ○ | ○ |
| 6-5 | Compound (1-14) | ○ | ○ | ○ | ○ |
| 6-6 | Compound (1-20) sodium salt | ○ | ◎ | ○ | ○ |

TABLE 19-continued

| Experiment No. | Covering Material | Anti-abrasion Property | Solubility | Storage Stability (Coloration) | Moisture Absorption Coefficient |
|---|---|---|---|---|---|
| 6-7 | Compound (1-38) sodium salt | ○ | ◎ | ○ | ○ |
| 6-8 | Compound (1-56) | ○ | ◎ | ○ | ○ |
| 6-9 | Compound (1-57) sulfuric acid salt | ○ | ○ | ○ | ○ |
| 6-10 | Compound (1-58) oxalic acid salt | ○ | ○ | ○ | ○ |
| 6-11 | Compound (3-2) | ○ | ○ | ○ | ○ |
| 6-12 | Compound (4-1) | ○ | ○ | ○ | ○ |
| 6-13 | $Na_2SO_3$ | ○ | ○ | ○ | ○ |
| 6-14 | Compound (1-7) (3 weight parts)/ PEG 4000 (7 weight parts) | ○ | ◎ | ○ | ◎ |
| 6-15 | Compound (1-7) (3 weight parts)/ Yuka Former AM-75W (7 weight parts) | ○ | ◎ | ○ | ◎ |
| 6-16 | Compound (1-7) (3 weight parts)/ Pineflow (7 weight parts) | ○ | ◎ | ○ | ◎ |

As is seen from Table above, the agent of the invention exhibits improved effects in anti-abrasion, solubility, storage coloration and moisture absorption.

Example 7

A tablet solid processing agent for a color paper was prepared in the following procedures.

1) Preparation of tablets

Procedure (13)

In a bandamu mill available on the market 1500.0 g of color developing agent CD-3 (4-amino-3-methyl-N-ethyl-N-β-(methanesulfonamido)ethylaniline sulfate) were pulverized to have an average particle size of 10 μm. In a mixer available on the market, 500.0 g of polyethylene glycol having a weight average molecular weight of 6000 were added to the above-mentioned fine powder and mixed. The resulting mixture was granulated for 7 minutes in a stirring granulator available on the market by adding 50 ml of water and then dried in a fluid-bed type drier available on the market for 2 hours at 40° C. to substantially remove moisture therefrom.

Procedure (14)

In a bandamu mill available on the market, 400.0 g of bis(sulfoethyl)hydroxylamine disodium salt, 1700.0 g of sodium p-toluene sulfonate, 300.0 g of Tinopar (produced by Ciba-Geigy Co., Ltd.) and 200.0 g of diethylenetriamine pentaacetic acid were individually pulverized to have an average particle size of 10 μm. In a mixer available on the market, 240.0 g of Pineflow (produced by Matsutani Kagaku Co., Ltd.) were added to the above-mentioned fine powder. The resulting mixture was granulated at room temperature for 7 minutes in a stirring granulator available on the market by adding 60 ml of water and then dried for 2 hours at 50° C. to substantially remove moisture.

Procedure (15)

In a bandamu mill available on the market 330.0 g of pentasodium diethylene-triamine pentaacetate, 130.0 g of sodium p-toluene sulfonate, 37.0 g of sodium sulfite, 340.0 g of lithium hydroxide monohydrate and 3300.0 g of anhydrous potassium carbonate were individually pulverized to have an average particle size of 10 μm. In a mixer available on the market, 500.0 g of polyethylene glycol having a weight average molecular weight of 4000 and 600.0 g of mannitol were added to the above-mentioned fine powder at not more than 40% RH. The resulting powder was granulated at room temperature for 7 minutes in a stirring granulator available on the market by adding 800 ml of water and then dried for 30 minutes at 60° C. to substantially remove moisture.

Procedure (16)

In a cross-rotary mixing machine available on the market were mixed the granules prepared in the above procedures (13) to (15). To the mixture 50.0 g of sodium N-mirystoylalanine were added and mixed in a mixer available on the market for 3 minutes. The resulting mixture was tableted at a tableting pressure of 7 t and at a loading amount of 10.5 g by using a rotary tableting machine (Clean Press Correct H18 manufactured by Kikusui Mfg. Works). Thus, color developing tablets for color paper each having a diameter of 30 mm and a thickness of 10 mm were obtained.

2) Coverage of tablets

The tablets prepared in 1) above were covered with a covering material shown in Table 20 in the same manner as in Example 2.

(Experiment)

The above obtained tablets were evaluated for anti-abrasion property, storage stability (coloration) and storage moisture absorption in the same manner as in Example 1 and the solubility was evaluated using the following solution.

| Color Developer for Color Paper (1 Liter) | |
|---|---|
| Dis(sulfoethyl)hydroxylamine disodium salt | 4.0 g |
| Sodium p-toluenesulfonate | 15.0 g |
| Tinopar (produced by Ciba-Geigy Co., Ltd.) | 3.0 g |
| Diethylenetriamine pentaacetic acid | 2.5 g |
| Potassium chloride | 3.5 g |
| Sodium sulfite | 0.2 g |
| Anhydrous potassium carbonate | 30.0 g |
| Pineflow | 15 g |
| Polyethylene glycol (weight average molecular weight: 4,000) | 5.0 g |
| Color developing agent (CD-3) | 6.5 g |

Adjusted with surfuric acid or sodium hydroxide to be pH 10.0.

The results are shown in the following Table.

TABLE 20

| Experiment No. | Type | Covering Material | Anti-abrasion Property | Solubility | Storage Stability (Coloration) | Moisture Absorption Coefficient |
|---|---|---|---|---|---|---|
| 7-1 | A | — | x | ◎ | x | x |
| 7-2 | C | Compound (1-2) disodium salt | ○ | ◎ | ◎ | ◎ |
| 7-3 | C | Compound (1-7) | ○ | ◎ | ◎ | ◎ |
| 7-4 | C | Compound (1-10) | ○ | ○ | ○ | ○ |
| 7-5 | C | Compound (1-14) | ○ | ◎ | ◎ | ○ |
| 7-6 | C | Compound (1-20) sodium salt | ○ | ◎ | ○ | ◎ |
| 7-7 | C | Compound (1-38) sodium salt | ○ | ◎ | ○ | ◎ |
| 7-8 | C | Compound (1-56) | ○ | ◎ | ○ | ◎ |
| 7-9 | C | Compound (1-57) sulfuric acid salt | ○ | ○ | ○ | ○ |
| 7-10 | C | Compound (1-58) oxalic acid salt | ○ | ○ | ○ | ○ |

TABLE 20-continued

| Experiment No. | Type | Covering Material | Anti-abrasion Property | Solubility | Storage Stability (Coloration) | Moisture Absorption Coefficient |
|---|---|---|---|---|---|---|
| 7-11 | C | Compound (3-2) | ○ | ○ | ○ | ○ |
| 7-12 | C | Compound (4-1) | ○ | ○ | ○ | ○ |
| 7-13 | C | $Na_2SO_3$ | ○ | ○ | ○ | ○ |
| 7-14 | C | Compound (1-7) (3 weight parts)/ PEG 4000 (7 weight parts) | ○ | ◎ | ◎ | * |
| 7-15 | C | Compound (1-7) (3 weight parts)/ Yuka Former AM-75W (7 weight parts) | ○ | ◎ | ◎ | * |
| 7-16 | C | Compound (1-7) (3 weight parts)/ Yuka Former AM-75W (4 weight parts)/ Yuka Former AM-75, 501 (3 weight parts) | ○ | ◎ | ◎ | * |
| 7-17 | B | Compound (1-7) (3 weight parts)/ Yuka Former AM-75W (4 weight parts)/ Yuka Former AM-75, 501 (3 weight parts) | ○ | ◎ | ◎ | ○ |
| 7-18 | B | Compound (1-7) | ○ | ◎ | ○ | ○ |

As is seen from Table above, the agent of the invention exhibits improved effects in anti-abrasion, solubility, storage coloration and moisture absorption. The solid processing agent further covered with at least one of a water-soluble polymer and saccharide exhibits especially improved effects. The processing using the agent of the invention is photographically stable.

Example 8

Experiment was carried out in the same manner as in Example 7, except that Exemplified compound (1-7) was used as a covering material for the solid color developing tablet for color paper of Example 7 and the coating amount was varied as shown in the following Table. The results are shown in the following Table.

TABLE 21

| Experiment No. | Coating Amount (weight %) | Anti-abrasion Property | Solubility | Storage Stability (Coloration) | Moisture Absorption Expansion Coefficient |
|---|---|---|---|---|---|
| 8-1 | — | x | ◎ | x | x |
| 8-2 | 0.01 | Δ | ◎ | Δ | Δ |
| 8-3 | 0.05 | ○ | ◎ | ○ | ○ |
| 8-4 | 0.1 | ○ | ◎ | ○ | ○ |
| 8-5 | 0.2 | ○ | ◎ | ◎ | ◎ |
| 8-6 | 1.0 | ○ | ◎ | ◎ | ◎ |
| 8-7 | 2.0 | ○ | ◎ | ◎ | ◎ |
| 8-8 | 5.0 | ○ | ○ | ○ | ◎ |
| 8-9 | 7.0 | Δ | Δ | Δ | Δ |

As is seen from Table above, the sample having a coating amount of not less than 0.05 weight % (particularly not less than 0.02 weight %) exhibits improved effects in anti-abrasion, solubility, storage coloration and moisture absorption. The sample having a coating amount of not more than 0.05 weight % (particularly not more than 0.02 weight %) also exhibits improved effects in anti-abrasion, solubility, storage coloration and moisture absorption.

Example 9

Experiment was carried out in the same manner as in Example 4 using the color developing tablet for color paper of Example 7 and the same results were obtained in the color developing tablet for color paper.

Example 10

A tablet solid processing agent was prepared in the same manner as in Example 7, except that a covering material as shown in the following Table was used instead of PEG 4000 used in Experiment No. 6-12 and evaluated in the same manner as in Example 7. The results are shown in Table below.

TABLE 22

| Experiment No. | Covering Material | Anti-abrasion Property | Solubility | Storage Stability (Coloration) | Moisture Absorption Expansion Coefficient |
|---|---|---|---|---|---|
| 10-1 | Polyethylene glycol having an weight average molecular weight of 2000 | ○ | ◎ | ◎ | ◎ |
| 10-2 (6-4) | Polyethylene glycol having an weight average molecular weight of 4000 | ○ | ◎ | ◎ | * |
| 10-3 | Polyethylene glycol having an weight average molecular weight of 6000 | ◎ | ◎ | ◎ | * |
| 10-4 | Polyethylene glycol having an weight average molecular weight of 8000 | ◎ | ◎ | ◎ | * |
| 10-5 | Polyethylene glycol having an weight average molecular weight of 10000 | ◎ | ○ | ◎ | * |
| 10-6 | Polypropylene glycol having an weight average molecular weight of 4000 | ○ | ◎ | ◎ | ◎ |
| 10-7 | Polypropylene glycol having an weight average molecular weight of 6000 | ◎ | ○ | ◎ | ◎ |
| 10-8 | Polypropylene glycol having an weight average molecular weight of 8000 | ◎ | ○ | ◎ | ◎ |

TABLE 23

| Experiment No. | Covering Material | Anti-abrasion Property | Solubility | Storage Stability (Coloration) | Moisture Absorption Expansion Coefficient |
|---|---|---|---|---|---|
| 10-9 | Yuka Former AM-75W(*4) | ◎ | ◎ | ◎ | * |
| 10-10 | Yuka Former AM-75, 501(*5) | ◎ | ◎ | ◎ | * |
| 10-11 | Yuka Former AM-75W/Yuka Former AM-75, 501 (1:1 mixture, weight ratio) | ◎ | ◎ | ◎ | * |

TABLE 23-continued

| Experiment No. | Covering Material | Anti-abrasion Property | Solubility | Storage Stability (Coloration) | Moisture Absorption Expansion Coefficient |
|---|---|---|---|---|---|
| 10-12 | Compound (B-1) | ◎ | ◎ | ○ | ◎ |
| 10-13 | Compound (B-2) | ◎ | ◎ | ○ | ◎ |
| 10-14 | Compound (B-4) | ◎ | ◎ | ○ | ◎ |
| 10-15 | Compound (B-5) | ◎ | ◎ | ○ | ○ |
| 10-16 | Compound (B-6) | ◎ | ◎ | ○ | ◎ |
| 10-17 | Compound (B-7) | ◎ | ◎ | ○ | ◎ |

TABLE 24

| Experiment No. | Covering Material | Anti-abrasion Property | Solubility | Storage Stability (Coloration) | Moisture Absorption Expansion Coefficient |
|---|---|---|---|---|---|
| 10-18 | Eudragid L30D55(*6) | ○ | ◎ | ○ | ◎ |
| 10-19 | Hydroxypropylcellulose having an weight average molecular weight of 1000 | ○ | ○ | ○ | ○ |
| 10-20 | Hydroxypropylcellulose having an weight average molecular weight of 5000 | ○ | ○ | ○ | ◎ |
| 10-21 | Hydroxypropylmethylcellulose having an weight average molecular weight of 1000 | ○ | ○ | ○ | ○ |
| 10-22 | Hydroxypropylmethylcellulose having an weight average molecular weight of 5000 | ◎ | ○ | ○ | ◎ |
| 10-23 | Pineflow(*7) | ◎ | ◎ | ○ | * |
| 10-24 | Pinedex | ◎ | ○ | ○ | ◎ |
| 10-25 | Anhydrous maltose | ◎ | ○ | ○ | ○ |
| 10-26 | Erythritol | ◎ | ◎ | ○ | * |
| 10-27 | Lactose | ○ | ○ | ○ | ○ |

(*4)Yuka Former AM-75W refers to a betaine type acrylic acid-acrylic acid copolymer produced by Mitsubishi Yuka Co., Ltd.
(*5)Yuka Former AM-75, 501 refers to a betaine type acrylic acid-acrylic acid copolymer produced by Mitsubishi Yuka Co., Ltd.
(*6)Eudragid L30D55 refers to a acrylic acid-methylacrylate copolymer produced by Leaphrma Co., Ltd.
(*7)Pineflow refers to dextrin produced by Matsutani Kagaku Co., Ltd.
(*8)Pinedex refers to dextrin produced by Matsutani Kagaku Co., Ltd.

As is seen from the above Tables, if the covering agent is changed, the invention is sufficiently effected. Particularly, polyethylene glycol having an weight average molecular weight of 4000 to 8000 or Yuka Former AM-75W or Yuka Former AM-75, 501 (produced by Mitsubishi Yuka Co., Ltd) gives an excellent results.

Example 11

Each of the tablets prepared in the No. 4-1, 4-2 or 4-3 of Example 4 was stored under storage methods or conditions shown in the following Table. Thereafter, the coloration was evaluated in the same manner as in Example 1. The results are shown in Table 25.

The storage method is as follows:

(a) Tablets were placed in a polyethylene package and tightly sealed.

(b) Tablets were placed in an aluminium-laminated polyethylene package and tightly sealed.

(c) Tablets were placed on a small dish and left as they are.

TABLE 25

| Experiment No. | Storage Condition: Temperature (°C.) | Relative Humidity (%) | Stored Period (days) | Storage Method | Tablets | Storage Stability |
|---|---|---|---|---|---|---|
| 11-1 | 25 | 40 | 5 | (a) | 4-1 | Δ |
| 11-2 | 25 | 40 | 5 | (a) | 4-2 | Δ |
| 11-3 | 25 | 40 | 5 | (a) | 4-3 | ⊙ |
| 11-4 | 30 | 50 | 14 | (a) | 4-1 | x |
| 11-5 | 30 | 50 | 14 | (a) | 4-2 | x |
| 11-6 | 30 | 50 | 14 | (a) | 4-3 | ⊙ |
| 11-7 | 50 | 50 | 14 | (b) | 4-1 | Δ |
| 11-8 | 50 | 50 | 14 | (b) | 4-2 | Δ |
| 11-9 | 50 | 50 | 14 | (b) | 4-3 | ⊙ |
| 11-10 | 25 | 40 | 5 | (c) | 4-1 | x |
| 11-11 | 25 | 40 | 5 | (c) | 4-2 | x |
| 11-12 | 25 | 40 | 5 | (c) | 4-3 | ⊙ |
| 11-13 | 35 | 45 | 5 | (c) | 4-1 | x |
| 11-14 | 35 | 45 | 5 | (c) | 4-2 | x |
| 11-15 | 35 | 45 | 5 | (c) | 4-3 | ○ |

As is seen from Table 25, the solid processing tablets of the invention exhibit an excellent storage stability under each of storage conditions, and the invention is markedly effected under the more severe storage condition.

What is claimed is:

1. A method of manufacturing a covered solid processing agent for a silver halide photographic light-sensitive material, the method comprising the step of:

forming granules;

molding the granules into a tablet to form a solid processing agent;

dissolving or dispersing in a solvent an additive selected from the group consisting of a sulfite and a compound represented by the following Formula (1), (3) or (4):

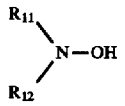

Formula (1)

wherein $R_{11}$ and $R_{12}$ independently represent a hydrogen atom or a substituted or unsubstituted alkyl group, provided that $R_{11}$ and $R_{12}$ may be the same or different or $R_{11}$ and $R_{12}$ may combine with each other to form a ring,

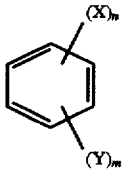

Formula (3)

wherein X represents an alkyl group or —OH; n represents an integer of 0 to 3; provided that when n is 2 or more, X may be the same or different; Y represents —COOM or —$SO_3M$ wherein M represents a hydrogen atom, an alkali metal or —$NH_4$; and m represents an integer of 1 to 3, provided that when m is 2 or more, Y may be the same or different;

A—COOM Formula (4)

wherein A represents a substituted alkyl or alkenyl group, in which the substituent is —OH or —COOM; and M represents a hydrogen atom, an alkali metal or —$NH_4$; and spray coating the surface of the solid processing agent in the form of the tablet with the resulting solution or dispersion to cover at least a portion of the surface of the tablet solid processing agent with the additive, wherein the weight content of the additive is 0.05 to 5% by weight of the agent.

2. The method of claim 1, wherein the weight content of the additive is 0.1 to 1 per 1 of the total amount of the additive and the covering agent.

3. The method of claim 1, wherein the compound represented by Formula (1) is a compound represented by the following Formula (2):

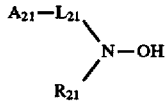

Formula (2)

wherein $R_{21}$ represents a hydrogen atom or an alkyl group; $L_{21}$ represents an alkylene group; and $A_{21}$ represents a carboxyl, sulfo, phosphono, phosphinic acid, hydroxy, amino, ammonio, carbamoyl or sulfamoyl group or $R_{21}$ and $L_{21}$ combine with each other to form a ring.

4. The method of claim 1, wherein the solid processing agent is in the form of a specific geometrical tablet.

5. The method of claim 1, further dissolving or dispersing in said solvent a covering agent selected from the group consisting of a water-soluble polymer and a saccharide.

6. The method of claim 1, wherein said at least a portion of the surface of the solid processing agent is not less than ½ of the surface area of the agent.

7. The method of claim 1, wherein said at least a portion of the surface of the solid processing agent is not less than 70% of the surface area of the agent.

8. The method of claim 1, wherein said at least a portion of the surface of the solid processing agent is the entire surface of the agent.

* * * * *